US011345164B2

(12) United States Patent
Hayashi

(10) Patent No.: US 11,345,164 B2
(45) Date of Patent: May 31, 2022

(54) THERMAL PRINT HEAD

(71) Applicant: ROHM Co., Ltd., Kyoto (JP)

(72) Inventor: Taro Hayashi, Kyoto (JP)

(73) Assignee: ROHM Co., Ltd., Kyoto (JP)

( * ) Notice: Subject to any disclaimer, the term of this patent is extended or adjusted under 35 U.S.C. 154(b) by 46 days.

(21) Appl. No.: 16/896,045

(22) Filed: Jun. 8, 2020

(65) Prior Publication Data

US 2021/0053367 A1 Feb. 25, 2021

(30) Foreign Application Priority Data

Aug. 22, 2019 (JP) ..... JP2019-152160

(51) Int. Cl.
*B41J 2/335* (2006.01)
*B41J 2/355* (2006.01)
*B41J 2/34* (2006.01)

(52) U.S. Cl.
CPC ..... *B41J 2/355* (2013.01); *B41J 2/3351* (2013.01); *B41J 2/3352* (2013.01); *B41J 2/3359* (2013.01); *B41J 2/33505* (2013.01); *B41J 2/33515* (2013.01); *B41J 2/33535* (2013.01); *B41J 2/34* (2013.01)

(58) Field of Classification Search
CPC ..... B41J 2/355; B41J 2/3352; B41J 2/33515; B41J 2/33505; B41J 2/3351; B41J 2/3359; B41J 2/33535; B41J 2/34
See application file for complete search history.

(56) References Cited

U.S. PATENT DOCUMENTS 4,707,708 A * 11/1987 Kitagishi ..... B41J 2/3357 347/202
5,231,420 A * 7/1993 Yamamoto ..... B41J 2/3351 29/611

(Continued)

FOREIGN PATENT DOCUMENTS

JP 2017114057 A 6/2017
JP 2019014233 A 1/2019
JP 2019166824 A 10/2019

*Primary Examiner* — Yaovi M Ameh
(74) *Attorney, Agent, or Firm* — Hamre, Schumann, Mueller & Larson, P.C.

(57) ABSTRACT

The present invention provides a thermal print head capable of better performing printing on a printing medium; the thermal print head including: a substrate (1), formed with single crystal semiconductor; a resistor layer (4), including a plurality of heating portions (41) arranged in a main scan direction; and a wiring layer (3), configuring a charging path to the plurality of heating portions. The substrate includes: a main surface (11), being a surface opposite to the resistor layer; and a convex portion (13), disposed as protruding from the main surface and extending in the main scan direction. The convex portion includes: an inclining surface (132), inclining relative to the main surface and extending in a linear manner when viewing from the main scan direction; and a curving surface (131), disposed, in a protruding direction of the convex portion, on a position farther away from the main surface than the inclining surface, and curving in a manner that protrudes toward the protruding direction. Each of the plurality of heating portions includes a heating curving portion (411) formed on a portion corresponding to the curving surface.

22 Claims, 28 Drawing Sheets

(56) References Cited

U.S. PATENT DOCUMENTS

2008/0117276 A1* 5/2008 Murakami ..... B41J 2/33515
347/202
2018/0354265 A1* 12/2018 Aoki ..... B41J 2/3357

* cited by examiner

THERMAL PRINT HEAD

BACKGROUND OF THE INVENTION

Field of the Invention

The present invention relates to a thermal print head.

Description of the Prior Art

Patent document 1 discloses a thermal print head having a substrate, a resistor layer and a wiring layer. The resistor layer includes a plurality of heating portions. The wiring layer configures a charging path to the plurality of heating portions.

PRIOR ART DOCUMENTS

Patent Publication

[Patent document 1] Japan Patent Publication No. 2017-114057

SUMMARY OF THE INVENTION

Problems to be Solved by the Invention

In a thermal print head such as that disclosed above, a printing medium is pressed toward the heating portions by, for example, a platen roller. Thus, heat of the heating portions is transmitted to the printing medium to print characters and images on the printing medium. At this point in time, for example, an issue that the printing medium cannot be readily pressed toward the heating portions if the position of the platen roller is shifted. On the basis of the description above, there is room for improvement of the thermal printer head.

It is an object of the present invention to provide a thermal print head capable of better performing printing on a printing medium.

Technical Means for Solving the Problem

A thermal print head for solving the described issue includes: a substrate, formed with single crystal semiconductor; a resistor layer, including a plurality of heating portions arranged in a main scan direction; and a wiring layer, configuring a charging path to the plurality of heating portions. The substrate includes: a main surface, being a surface opposite to the resistor layer; and a convex portion, disposed as protruding from the main surface and extending in the main scan direction. The convex portion includes: an inclining surface, inclining relative to the main surface and extending in a linear manner when viewing from the main scan direction; and a curving surface, disposed, in a protruding direction of the convex portion, on a position farther away from the main surface than the inclining surface, and curving in a manner that protrudes toward the protruding direction. Each of the plurality of heating portions includes a heating curving portion formed on a portion corresponding to the curving surface.

According to the configuration, the heating curving portions are curved, and hence a printing medium may be more readily pressed toward the heating curving portions. Therefore, printing on the printing medium may be better performed.

Effects of the Invention

The thermal print head according to the description above is capable of better performing printing on a printing medium.

DETAILED DESCRIPTION OF THE EMBODIMENTS

Embodiments of a thermal print head are to be described with the accompanying drawings below. The embodiments below are only examples for explaining specific configurations and methods of the technical concept, and do not form limitations to the materials, shapes, structures, arrangements or sizes of constituting components. Various modifications may be made to the embodiments described below.

First Embodiment

A thermal print head A1 is assembled into a printer implementing printing on a printing medium 99 transported by a platen roller 91. The printing medium 99 is, for example, thermal paper. Barcode covers and receipts are manufactured by having the thermal print head A1 printing on the thermal paper.

Furthermore, in the first embodiment, the direction in which the thermal print head A1 transports the printing medium 99 is a sub scan direction y, and the direction orthogonal to both the sub scan direction y and the thickness direction of the printing medium 99 is a main scan direction x. The dimension of the printing medium 99 in the main scan direction x is the width of the printing medium 99. The printing medium 99 is transported in the sub scan direction y from upstream to downstream.

Figure 1:
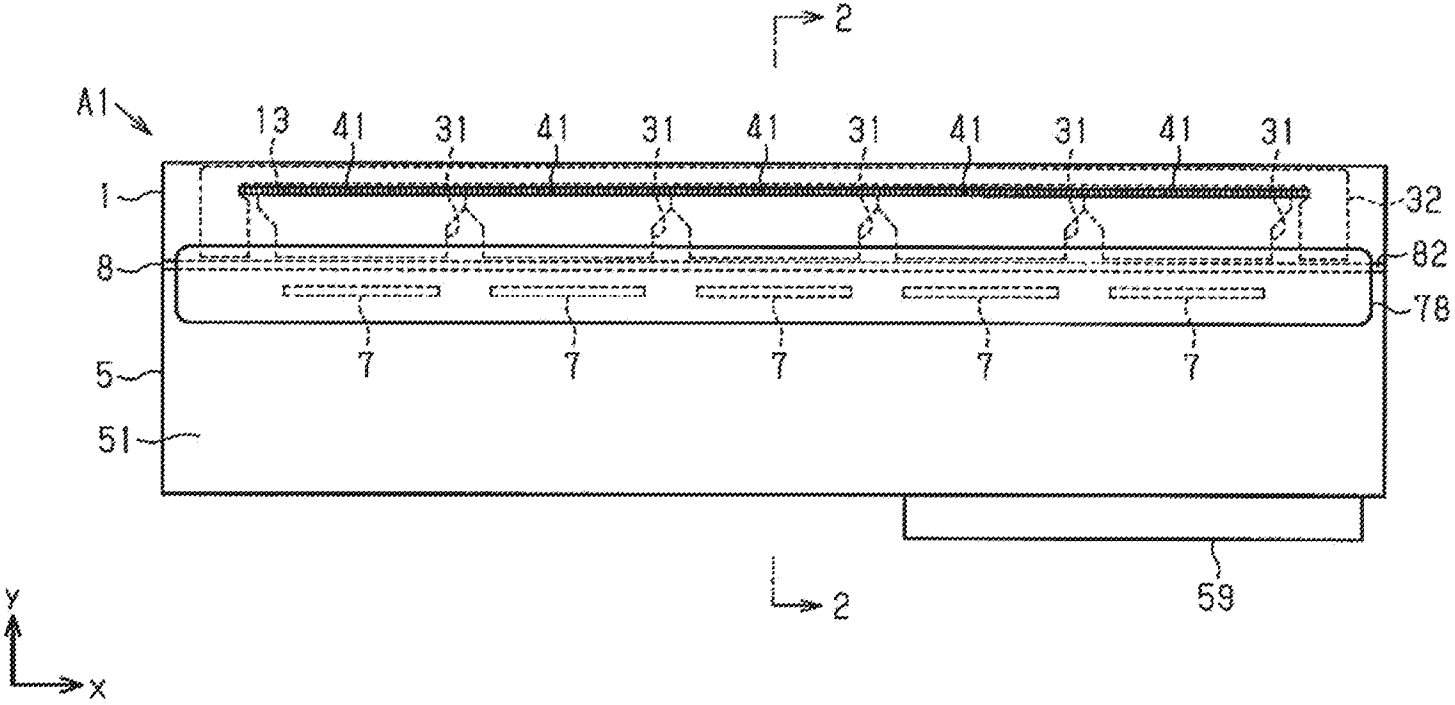
FIG. 1 is a top view of a thermal print head according to a first embodiment.
Figure 2:
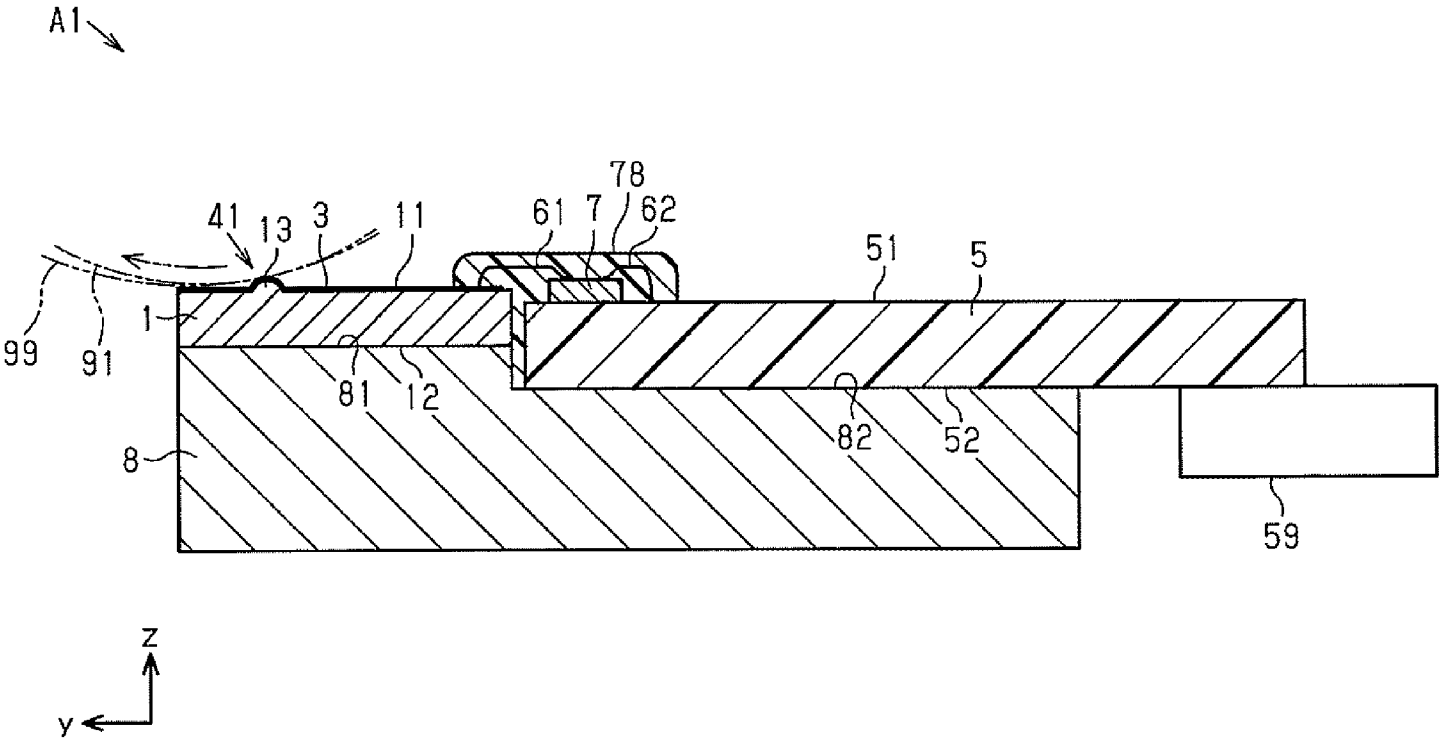
FIG. 2 is a cross-sectional diagram taken along line 2-2 in FIG. 1.

As shown in FIG. 1 and FIG. 2, the thermal print heat A1 includes a substrate 1. The substrate 1 includes single crystal semiconductor, and includes, for example, Si or TaN.

The substrate 1 has a first main surface 11, and a first back surface 12 opposite to the first main surface 11. The first main surface 11 and the first back surface 12 are surfaces crossing in a thickness direction z of the substrate 1, and are orthogonal to the thickness direction z in the first embodiment. The thickness direction z is a direction orthogonal to both the main scan direction x and the sub scan direction y. Furthermore, for illustration purposes, in the thickness direction z, a direction away from the first main surface 11 is referred to as "above".

The substrate 1 is configured as, for example, a rectangle when viewing from the top. In the first embodiment, the substrate 1 is configured as a long strip in the main scan direction x. Thus, in the first embodiment, the dimension of the substrate 1 in the sub scan direction y is less than the dimension of the substrate 1 in the main scan direction x.

The dimension of the substrate 1 in the main scan direction x is, for example, equal to or more than 100 mm and equal to or less than 150 mm. The dimension of the substrate 1 in the sub scan direction y is, for example, equal to or more than 1.0 mm and equal to or less than 5.0 mm. The dimension of the substrate 1 in the thickness direction z is, for example, 725 μm. In the substrate 1, the dimension of the thickest part is 725 μm. The shape and dimensions of the substrate 1 are not limited to the examples given above.

As shown in FIG. 1 to FIG. 4, the substrate 1 includes a convex portion 13 protruding from the first main surface 11. The convex portion 13 extends in the main scan direction x. In other words, the extension direction of the convex portion 13 is the main scan direction x.

The convex portion 13 includes single crystal semiconductor, and includes, for example, Si or TaN. In this first embodiment, the convex portion 13 and the substrate 1 are formed integrally.

Figure 3:
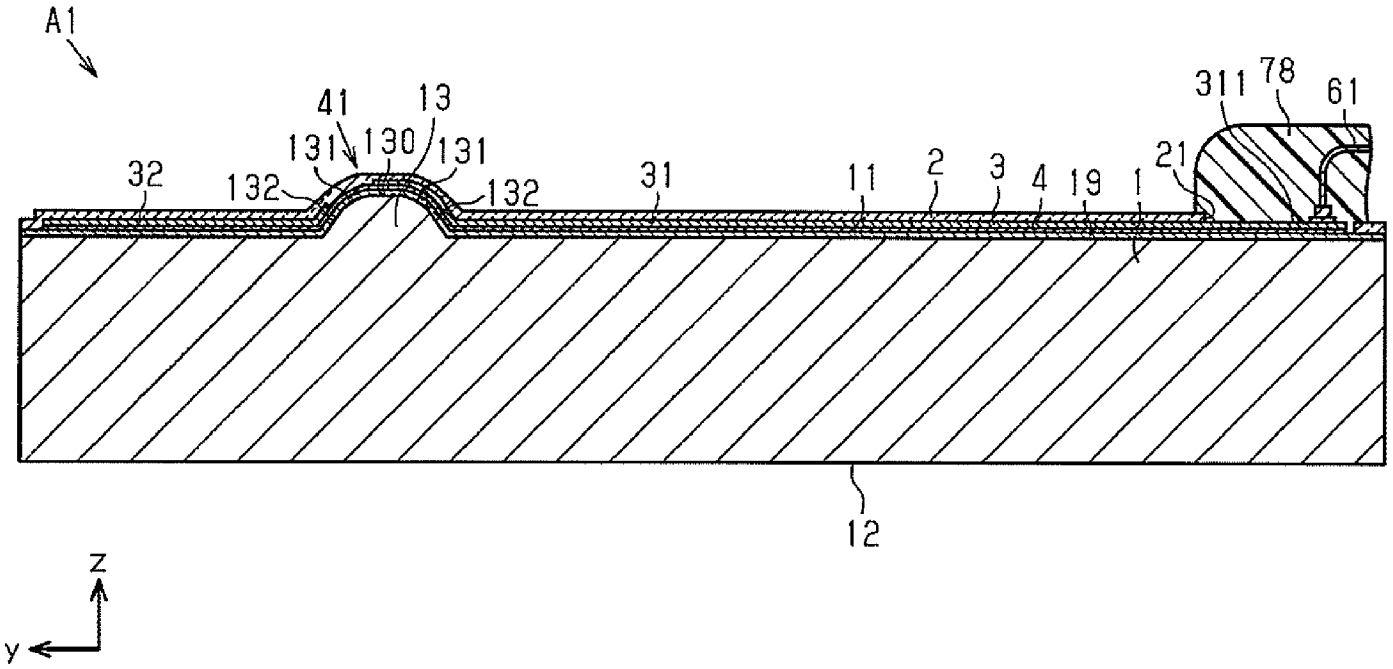
FIG. 3 is an enlarged diagram of FIG. 2.
Figure 4:
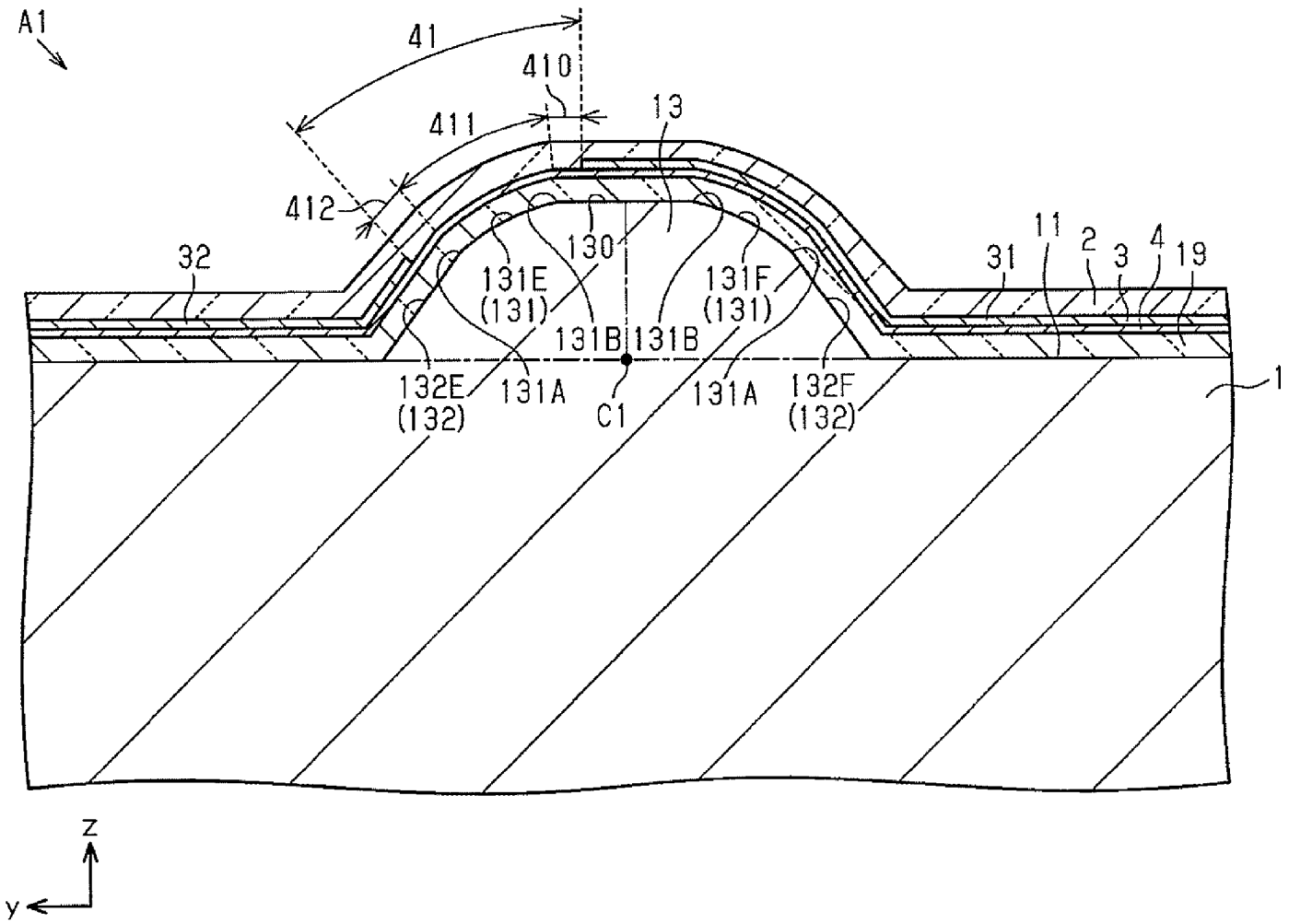
FIG. 4 is an enlarged diagram of FIG. 3.

As shown in FIG. 2 to FIG. 4, in the first embodiment, the protruding direction of the convex portion 13 is a direction from the first back surface 12 toward the first main surface 11. Furthermore, the protruding direction of the convex portion 13 in other words is a direction away from the first main surface 11 relative to the thickness direction z of the substrate 1, that is, a direction above.

The dimension of the convex portion 13 in the thickness direction z is, for example, equal to or more than 150 μm and equal to or less than 300 μm. In the first embodiment, the convex portion 13 is located, in the sub scan direction y, more downstream than the center of the substrate 1 when viewing the substrate 1 from the main scan direction x.

As shown in FIG. 4, the convex portion 13 has a top surface 130. In the convex portion 13, the top surface 130 is a surface on a position spaced by a longest distance from the first main surface 11 in the protruding direction. The top surface 130 in the first embodiment is a plane parallel to the first main surface 11. The top surface 130 is configured as a rectangular strip in the main scan direction x when viewing the substrate 1 from the top.

The convex portion 13 has an inclining surface 132 which is a surface inclining relative to the first main surface 11. The inclining surface 132 inclines relative to the first main surface 11 in the thickness direction z and extends upward from the first main surface 11. The inclining surface 132 inclines in a linear manner when viewing from the main scan direction x.

The convex portion 13 of the first embodiment has two inclining surfaces 132 which are located on positions spaced by the top surface 130 in the sub scan direction y. For illustration purposes, the inclining surface 132 located more downstream in the sub scan direction y than the top surface 130 is set as a first inclining surface 132E, and the inclining surface 132 located more upstream than the top surface 130 is set as a second inclining surface 132F. In the first inclining surface 132E, the end portion located at the downstream in the sub scan direction y is connected to the first main surface 11. In the second inclining surface 132F, the end portion located at the upstream in the sub scan direction y is connected to the first main surface 11. The first inclining surface 132E and the second inclining surface 132F incline in a manner of gradually approaching each other in a direction away from the first main surface 11.

The convex portion 13 has a curving surface 131. The curving surface 131 is disposed, in a protruding direction of the convex portion 13, on a position farther away from the first main surface 11 than the inclining surface 132. The curving surface 131 is located between the top surface 130 and the inclining surface 132 in the sub scan direction y, and is connected to the top surface 130 and the inclining surface 132. That is to say, the curving surface 131 has a first end 131A connected to the inclining surface 132, and a second end 131B connected to the top surface 130.

The curving surface 131 curves in a manner of protruding in the protruding direction of the convex portion 13 when viewing from the main scan direction x. The curving surface 13 curves, for example, in a manner of protruding toward a radial outer side relative to a center C1 of the convex portion 13 when viewing from the main scan direction x. In the first embodiment, the curving surface 131 appears as an arc in shape. The center C1 is the center of the convex portion 13 in the sub scan direction y, and is a point located on the same position as the first main surface 11 in the thickness direction z.

When viewing from the main scan direction x, the convex portion 13 is in a shape with an arc on the basis of the curving surface 131. The border portion between the inclining surface 132 and the curving surface 131 is curved at the convex portion 13, and the border portion between the top surface 130 and the curving surface 131 is curved at the convex portion 13. That is to say, the border portion between the inclining surface 132 and the curving surface 131 and the border portion between the top surface 130 and the curving surface 131 become round at the convex portion 13.

Figure 10:
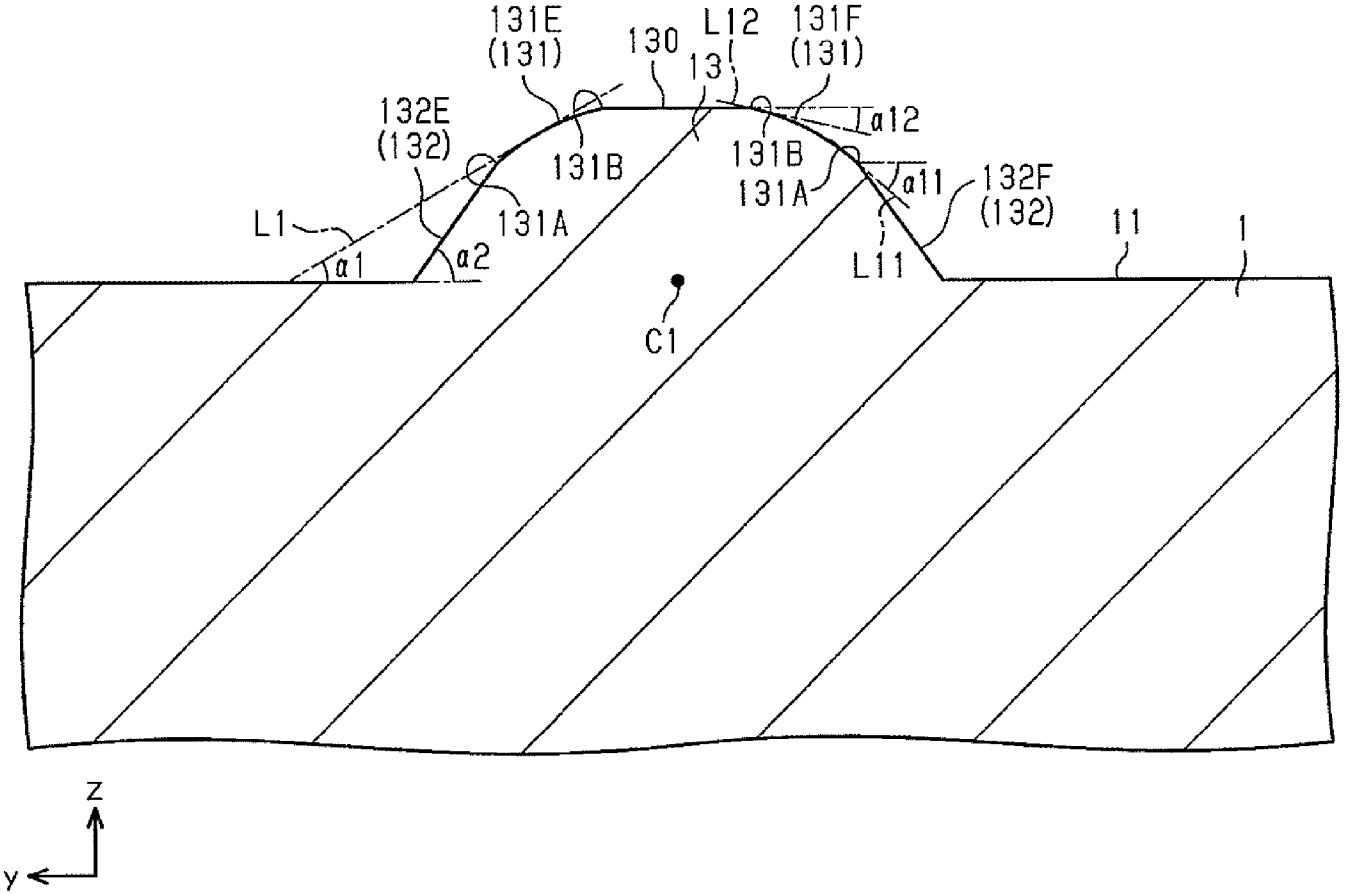
FIG. 10 is an enlarged diagram of FIG. 9.

As shown in FIG. 10, an angle $\alpha 1$ formed by a tangential line L1 of a first curving surface 131E and the first main surface 11 is equal to or less than an angle α2 formed by the first inclining surface 132E and the first main surface 11.

In the first embodiment, the first surface 11 is a (100) surface. In the first embodiment, the angle α1 is equal to or more than 20 degrees and equal to or less than 40 degrees. Preferably, the angle α1 is equal to or more than 22 degrees and equal to or less than 37 degrees. In the first embodiment, an angle α11 formed by a tangential line L11 at the first end 131A and the first main surface 11 is, for example, 37 degrees, and an angle α12 formed by a tangential line L12 at the second end 131B and the first main surface 11 is, for example, 22 degrees. That is to say, the curving surface 131 curves from the first end 131A toward the second end 131B in a manner that the angle α1 of the tangential line relative to the first main surface 11 gradually decreases.

In the first embodiment, the angle α2 represents an angle of a rising slope of the inclining surface 132 extending from the first main surface 11 toward the top surface 130. The angle α2 is equal to or more than 50 degrees and equal to or less than 60 degrees, and is preferably 54.7 degrees.

In the first embodiment, the length of the curving surface 131 in the thickness direction z is less than the length of the inclining surface 132 in the thickness direction z. The dimension of the curving surface 131 in the thickness direction z is, for example, 50 μm. The dimension of the inclining surface 132 in the thickness direction z is, for example, 100 μm.

In the first embodiment, the length of the curving surface 131 in the sub scan direction y is equal to or more than the length of the inclining surface 132 in the sub scan direction y. The dimension of the curving surface 131 in the sub scan direction y is, for example, 100 μm. The dimension of the inclining surface 132 in the sub scan direction y is, for example, 75 μm.

The convex portion 13 of the first embodiment has two curving surfaces 131. The two curving surfaces 131 are located on positions spaced by the top surface 130 in the sub scan direction y. For illustration purposes, in the sub scan direction y, the curving surface 131 located more downstream than the top surface 130 is set as a first curving surface 131E, and the curving surface 131 located more upstream than the top surface 130 is set as a second curving surface 131F. The first curving surface 131E and the second curving surface 131F curve in a manner of gradually approaching each other in a direction away from the first main surface 11.

The first curving surface 131E is located between the top surface 130 and the first inclining surface 132E in the sub scan direction y, and is connected to the top surface 130 and the first inclining surface 132E in the sub scan direction y.

The second curving surface 131F is located between the top surface 130 and the second inclining surface 132F in the sub scan direction y, and is connected to the top surface 130 and the second inclining surface 132F in the sub scan direction y.

In the first embodiment, the two curving surfaces 131 and the two inclining surfaces 132 are in a symmetric arrangement in the sub scan direction y by using the top surface 130 as a reference. That is to say, the convex portion 13 is configured as symmetric in shape in the sub scan direction y with the center of the convex portion 13 as the reference when viewing from the main scan direction x.

As shown in FIG. 3 and FIG. 4, the thermal print head A1 includes an insulating layer 19. The insulating layer 19 is formed on the substrate 1, and more specifically, formed on the first main surface 11. The insulating layer 19 is located on a position covering the first main surface 11 and the convex portion 13.

The insulating layer 19 includes an insulating material. The insulating layer 19 includes, for example, $SiO_2$, SiN or TEOS. TEOS is tetraethyl orthosilicate. The insulating layer 19 of the first embodiment includes TEOS. The thickness of the insulating layer 19 is, for example, equal to or more than 5 μm and equal to or less than 15 μm. In the first embodiment, the thickness of the insulating layer 19 is 10 μm. The thickness of the insulating layer 19 is not limited to the examples above.

The thermal print head A includes a wiring layer 3 and a resistor layer 4. In the first embodiment, the resistor layer 4 and the wiring layer 3 are sequentially laminated relative to the first main surface 11. More specifically, the resistor layer 4 is laminated on the insulating layer 19, and the wiring layer 3 is laminated on the resistor layer 4. In this case, the resistor layer 4 and the insulating layer 3 are insulated from the substrate 1 by the insulating layer 19. That is to say, the insulating layer 19 insulates the substrate 1 from the resistor layer 4 and the wiring layer 3.

In the first embodiment, the resistor layer 4 is opposite to the first main surface 11 with the insulating layer 19 located between the two. The resistor layer 4 is located at a position that covers the first main surface 11 and the convex portion 13. The resistor layer 4 is, on the convex portion 13, located at a position that covers the top surface 130, the curving surface 131 and the inclining surface 132.

The resistor layer 4 includes, for example, Si or TaN. The thickness of the resistor layer 4 is, for example, equal to or more than 0.02 μm and equal to or less than 0.10 μm. In this first embodiment, the thickness of the resistor layer 4 is 0.05 μm. The thickness of the resistor layer 4 is not limited to the examples above.

Figure 5:
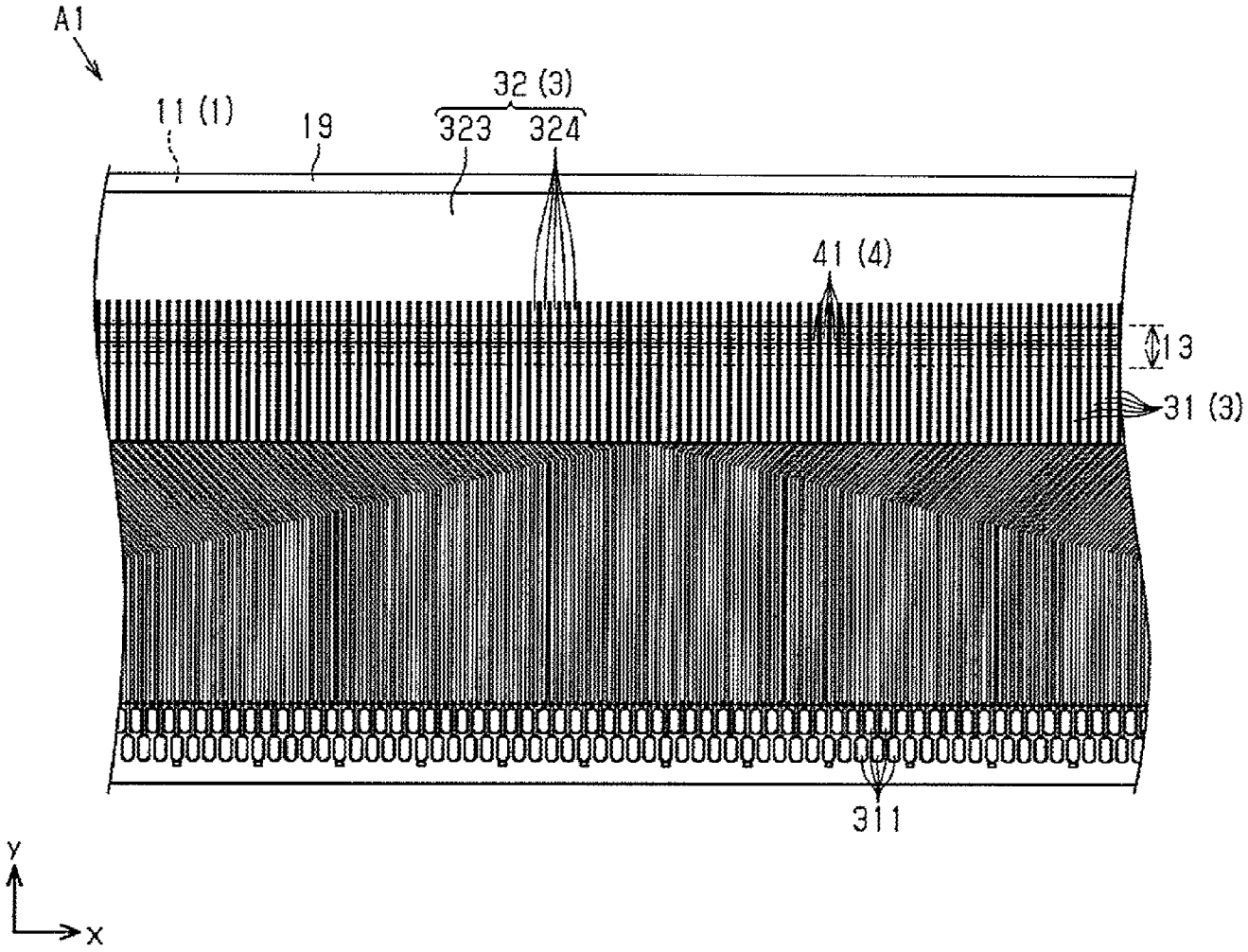
FIG. 5 is a top view of a wiring layer.

As shown in FIG. 5, the resistor layer 4 includes a plurality of heating portions 41 located on the convex portion 13. In the first embodiment, a portion of the resistor layer 4 configured on the convex portion 13 is not covered by the wiring layer 3. Furthermore, the plurality of heating portions 41 are formed by a portion of the resistor layer 4 configured on the convex portion 13, wherein said portion is not covered by the wiring layer 3.

Figure 6:
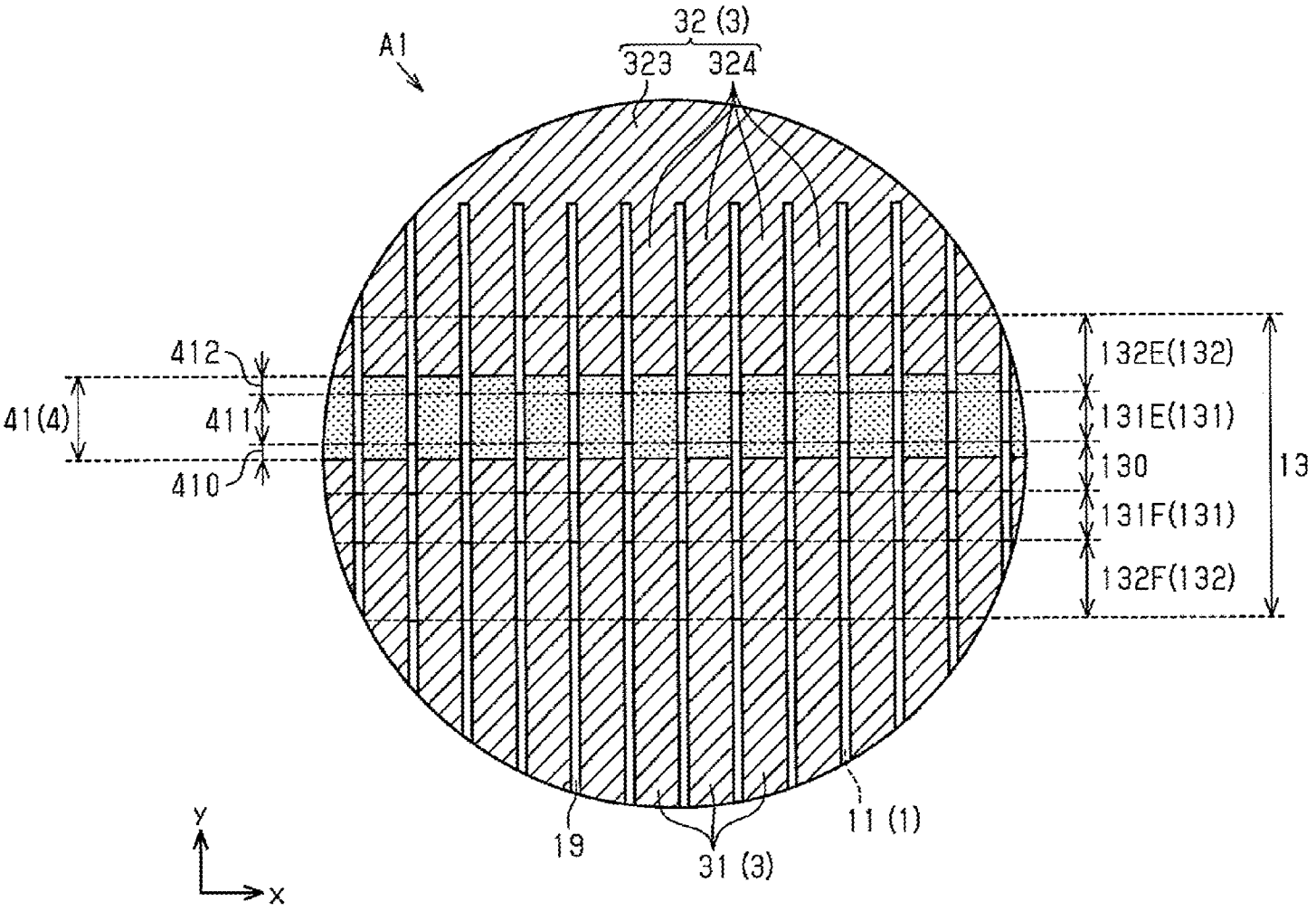
FIG. 6 is an enlarged diagram of FIG. 5.

As shown in FIG. 6, each heating portion 41 of the first embodiment is configured as a rectangular strip in the sub scan direction y when viewing from the top of the substrate 1. The shape of the heating portion 41 is not limited to the examples above. The plurality of heating portions 41 are arranged in the main scan direction x.

The plurality of heating portions 41 are selectively powered, so as to partially heat the printing medium 99 pressed by the plurality of heating portions 41. Accordingly, characters may be printed on the printing medium 99.

The heating portions 41 are described in detail below.

As shown in FIG. 4, each heating portion 41 includes a heating curving portion 411 formed on a portion corresponding to the first curving surface 131E. The heating curving portion 411 is formed by a portion of the resistor layer 4, wherein said portion is formed on the first curving surface 131E. The surface of the heating curving portion 411 curves in a manner corresponding to the first curving surface 131E.

In the first embodiment, the heating curving portion 411 is disposed in the sub scan direction y throughout the full length of the first curving surface 131E. That is to say, the heating curving portion 411 is disposed as crossing from the first end 131A to the second end 131B on the first curving surface 131E.

Each heating portion 41 includes a heating inclining portion 412 formed on a portion corresponding to the first inclining surface 132E. The heating inclining portion 412 is a part of a portion of the resistor layer 4, wherein said portion is formed on the first inclining surface 132E. In the first embodiment, the heating inclining portion 412 is more downstream in the sub scan direction y than the heating curving portion 411. The surface of the heating inclining portion 412 inclines relative to the first main surface 11 in a manner corresponding to the first inclining surface 132E.

In the first embodiment, the heating inclining portion 412 is not provided on the entire first inclining surface 132E, but is provided on a part of the first inclining surface 132E. The heating inclining portion 412 is provided on the first inclining surface 132E on an end portion at the upstream of the sub scan direction y, and is not provided on an end portion at the downstream of the sub scan direction y.

The heating inclining portion 412 and the heating curving portion 411 are continuous. Thus, the heating portion 41 is disposed as crossing the first curving surface 131E and the first inclining surface 132E on the convex portion 13. That is to say, the heating portion 41 is disposed as crossing the border between the first curving surface 131E and the first inclining surface 132E.

The heating portion 41 includes a heating top portion 410 formed on a portion corresponding to the top surface 130. The heating top portion 410 is a part of a portion of the resistor layer 4, wherein said portion is formed on the top surface 130. In the first embodiment, the heating top portion 410 is located more upstream in the sub scan direction y than the heating curving portion 411. The surface of the heating top portion 410 is a plane parallel to the top surface 130.

In the first embodiment, the heating top portion 410 is not provided on the entire top surface 130, but is provided on a part of the top surface 130. The heating top portion 410 is provided on the top surface 130 on an end portion at the downstream in the sub scan direction y, and is not provided on an end portion at the upstream of the sub scan direction y.

The heating top portion 410 and the heating curving portion 411 are continuous. Thus, the heating portion 41 is disposed as crossing the top surface 130 and the first curving surface 131E on the convex portion 13. That is to say, the heating portion 41 is disposed as crossing the border between the top surface 130 and the first curving surface 131E.

As described above, in the first embodiment, the heating portion 41 is formed as crossing the first curving surface 131E and both the side portions of the first curving surface 131E in the sub scan direction y.

The wiring layer 3 configures a charging path to the plurality of heating portions 41. The wiring layer 3 includes, for example, a metal material. The wiring layer 3 includes, for example, Cu. The wiring layer 3 may also include a plurality of metal materials. For example, the wiring layer 3 may also include a Cu-containing layer and a Ti-containing layer. In this case, the Ti-containing layer is preferably located between the Cu-containing layer and the resistor layer 4. The thickness of the Ti-containing layer is, for example, 100 nm. The thickness of the wiring layer 3 is, for example, equal to or more than 0.3 μm and equal to or less than 2.0 μm. The thickness of the wiring layer 3 is not limited to the examples above.

As shown in FIG. 5, the wiring layer 3 includes a plurality of separating electrodes 31 and a common electrode 32. The separating electrodes 31 and the common electrode 32 are located on positions spaced by the heating portions 41 in the sub scan direction y. In other words, in the resistor layer 4, a plurality of portions between the plurality of separating electrodes 31 and the common electrode 32 and exposed from the wiring layer 3 become the plurality of heating portions 41.

As shown in FIG. 5 and FIG. 6, the separating electrodes 31 are more upstream in the sub scan direction y than the heating portions 41. The separating electrodes 31 are configured as extending in the sub scan direction y, and are configured, for example, as bands in shape.

The separating electrodes 31 are formed on portions corresponding to the second inclining surface 132F and the second curving surface 131F. The separating electrodes 31 extend out from the second curving surface 131F toward the downstream in the sub scan direction y, and overlap a part of the top surface 130. Thus, in the separating electrodes 31, end portions located at the downstream in the sub scan direction y are disposed on positions overlapping the top surface 130. Therefore, a part of the resistor layer 4 formed on the top surface 130 is covered by the separating electrodes 31, and the rest forms the heating top portion 410.

The separating electrodes 31 are electrodes connected to a metal wire 61. As shown in FIG. 5, each separating electrode 31 includes a separating pad 311 serving as a wire bonding pad. In the separating electrode 31, the separating pad 311 is a portion that is connected to the metal wire 61. A protective layer 2, protective resin 78 and the metal wire 61 are omitted from FIG. 5 for illustration purposes.

As shown in FIG. 6, the common electrode 32 is located more downstream in the sub scan direction y than the heating portions 41. The common electrode 32 includes a connecting portion 323 and a plurality of band portions 324. In the common electrode 32, the connecting portion 323 is connected to the plurality of band portions 324, and extends in the main scan direction x. The dimension of the connecting portion 323 in the sub scan direction y is equal to or more than the dimension of the band portions 324 in the sub scan direction y.

The band portions 324 are located more upstream in the sub scan direction y than the connecting portion 323, and extend as bands from the connecting portion 323. In the band portions 324, end portions located at the upstream of the sub scan direction y are configured on positions overlapping the first inclining surface 132E. Thus, a part of the resistor layer 4 formed on the first inclining surface 132E is covered by the band portions 324 of the common electrode 32, and the rest forms the heating inclining portion 412. In the band portions 324, end portions located at the upstream in the sub scan direction y are an end portion of the common electrode 32 located at the upstream in the sub scan direction y.

As shown in FIG. 4, the thermal print head A1 of the first embodiment includes the protective layer 2. In the first embodiment, the insulating layer 19, the resistor layer 4, the wiring layer 3 and the protective layer 2 are sequentially laminated relative to the first main surface 11.

The protective layer 2 is formed on the wiring layer 3, and on the portion of the resistor layer 4 that is not covered by the wiring layer 3, that is, the heating portions 41. The protective layer 2 is located on a position covering the first main surface 11 and the convex portion 13. The protective layer 2 covers and hence protects the wiring layer 3 and the heating portions 41 of the resistor layer 4.

The protective layer 2 includes an insulating material. The protective layer 2 includes one or more layers, and includes materials such as $SiO_2$, SiN, SiC, or AlN. For example, the protective layer 2 may also include a $SiO_2$-containing layer and an AlN-containing layer. The thickness of the protective layer 2 is, for example, equal to or more than 1.0 μm and equal to or less than 10 μm. The thickness of the protective layer 2 is not limited to the examples above.

As shown in FIG. 3, a pad opening 21 is formed at the protective layer 2. The pad opening 21 is, for example, an opening passing through the protective layer 2 in the thickness direction z. The pad opening 21 is provided as plural in quantity. The pad opening 21 is an opening for connecting the metal wire 61 to the separating electrodes 31 of the wiring layer 3. The pad opening 21 exposes the separating pads 311.

Herein, if power is supplied to the wiring layer 3 and the resistor layer 4, the heating portions 41 in the resistor layer 4 that are exposed from the wiring layer 3 become heated. The heat generated from the heating portions 41 is transmitted through the protective layer 2 to the printing medium 99, allowing printing of such as characters on the printing medium 99.

As shown in FIG. 1 and FIG. 2, the thermal print head A1 includes a circuit substrate 5. The circuit substrate 5 is located, for example, on a position side by side with the substrate 1 in the sub scan direction y. In the first embodiment, the circuit substrate 5 is located more upstream in the sub scan direction y than the substrate 1. The circuit substrate 5 is, for example, a printed circuit board (PCB) substrate.

The circuit substrate 5 has a second main surface 51, and a second back surface 52 as a surface opposite to the second main surface 51. In the first embodiment, the second main surface 51 is parallel to the first main surface 11. In the first embodiment, the second main surface 51 is located between the first main surface 11 and the first back surface 12 with respect to the substrate 1.

The circuit substrate 5 is configured as a rectangle in shape when viewing from the top. In the first embodiment, the circuit substrate 5 is configured to be a long strip in the main scan direction x. Thus, in the first embodiment, the dimension of the circuit substrate 5 in the sub scan direction y is less than the dimension of the circuit substrate 5 in the main scan direction x.

In the circuit substrate 5, the distance between the second main surface 51 and the second back surface 52 is the thickness of the circuit substrate 5. The thickness of the circuit substrate 5 is more than the thickness of the substrate 1. That is to say, the dimension of the circuit substrate 5 in the thickness direction z is more than the dimension of the substrate 1 in the thickness direction z. The shape and dimensions of the circuit substrate 5 are not limited to the examples above.

The thermal print head A1 includes a driver integrated circuit 7. In the first embodiment, the driver integrated circuit 7 is provided as plural in quantity. The driver integrated circuits 7 are disposed on the circuit substrate 5, and are disposed on the second main surface 51. The driver integrated circuits 7 are integrated circuits that control powering to the heating portions 41, and individually supply power to the plurality of heating portions 41.

The driver integrated circuits 7 are connected to the wiring layer 3 by the metal wire 61. In the first embodiment, the metal wire 61 is connected to the driver integrated circuits 7 and the separating pads 311. The metal wire 61 is provided as plural in quantity corresponding to the quantity of the separating electrodes 31. The driver integrated circuits 7 are connected to the wiring layer (not shown) formed on the circuit substrate 5 by a plurality of metal wires 62.

The driver integrated circuits 7 control powering to the plurality of heating portions 41 according to an instruction signal inputted through the circuit substrate 5 from the outside of the thermal print head A1. For example, the driver integrated circuits 7 individually control powering to the respective heating portions 41 according to a signal sent from a central processing unit (CPU) included in the printer. In the first embodiment, the plurality of driver integrated circuits 7 are provided according to the quantity of the plurality of heating portions 41.

The thermal print head A1 includes the protective resin 78. The protective resin 78 covers and hence protects the driver integrated circuits 7, the metal wire 61 and the metal wires 62. In the first embodiment, the protective resin 78 is located on a position crossing the substrate 1 and the circuit substrate 5. The protective resin 78 is, for example, insulating resin. The protective resin 78 is, for example, black insulating resin.

The thermal print head A1 includes a connector 59. The connector 59 is used when the thermal print head A1 is connected to a printer. The thermal print head A1 is connected to the printer by the connector 59. The connector 59 is disposed on the circuit substrate 5. The connector 59 is connected to the wiring layer on the circuit substrate 5 connected to the metal wires 62.

The thermal print head A1 includes a heat dissipation member 8. The heat dissipation member 8 supports the substrate 1 and the circuit substrate 5, and dissipates part of heat generated by the heating portions 41 to the outside. That is to say, the heat dissipation member 8 functions as a heat dissipater. The heat dissipation member 8 includes, for example, metal. The heat dissipation member 8 includes, for example, aluminum. In the first embodiment, the heat dissipation member 8 is configured as a block.

In the first embodiment, the heat dissipation member 8 has a first support surface 81 and a second support surface 82. The first support surface 81 and the second support surface 82 are located on positions side by side in the sub scan direction y. The first support surface 81 and the second support surface 82 are parallel to each other.

The first support surface 81 is a surface bonded with the substrate 1, and is bonded with the first back surface 12. The second support surface 82 is a surface bonded with the circuit substrate 5, and is bonded with the second back surface 52. The second support surface 82 is located more upstream in the sub scan direction y than the first support surface 81. The second support surface 82 is located more upstream in the sub scan direction y than the first support surface 81.

Next, an example of a method for manufacturing the thermal print head A1 is described below.

The method for manufacturing the thermal print head A1 includes a convex portion formation step for forming the convex portion 13. The convex portion formation step is described below.

Figure 7:
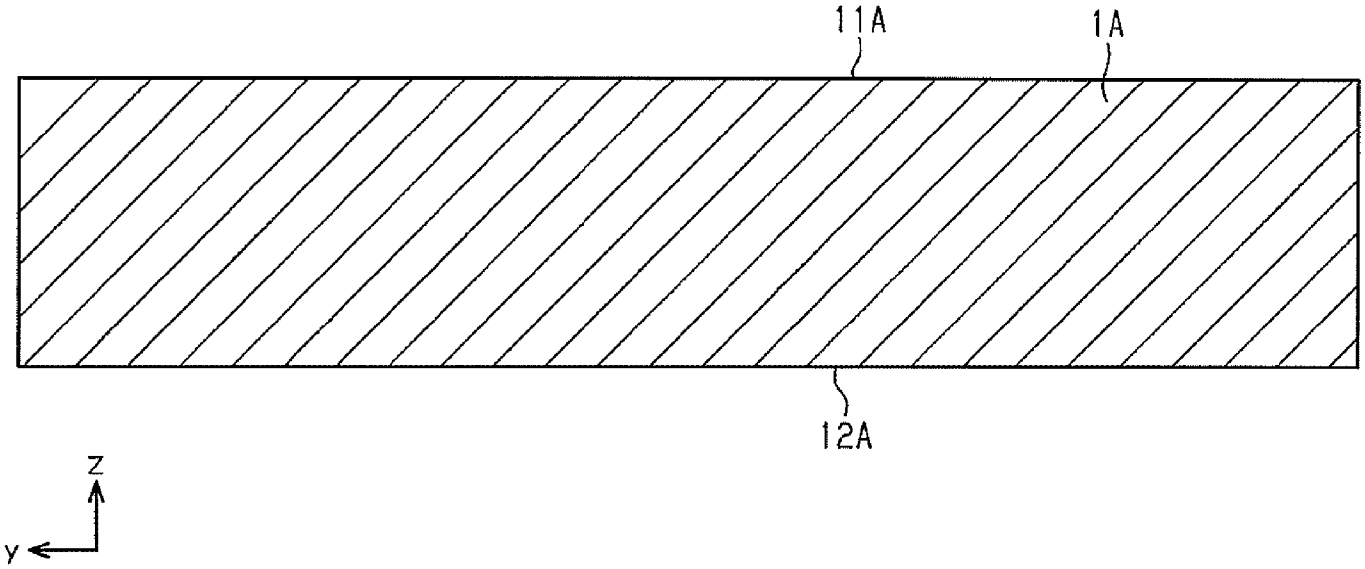
FIG. 7 is a cross-sectional diagram of a substrate material.

As shown in FIG. 7, a substrate material 1A including single crystal semiconductor is prepared. The substrate material 1A is, for example, Si wafer. The thickness of the substrate material 1A is, for example but not limited to, 725 μm. The substrate material 1A has a first surface 11A, and a second surface 12A opposite to the first surface 11A. In the first embodiment, the first surface 11A is a (100) surface. Furthermore, the substrate material 1A may also be TaN wafer.

Next, the first surface 11A of the substrate material 1A is covered by a predetermined mask layer. Then, anisotropic etching of the first surface 11A is implemented by using such as KOH.

Figure 8:
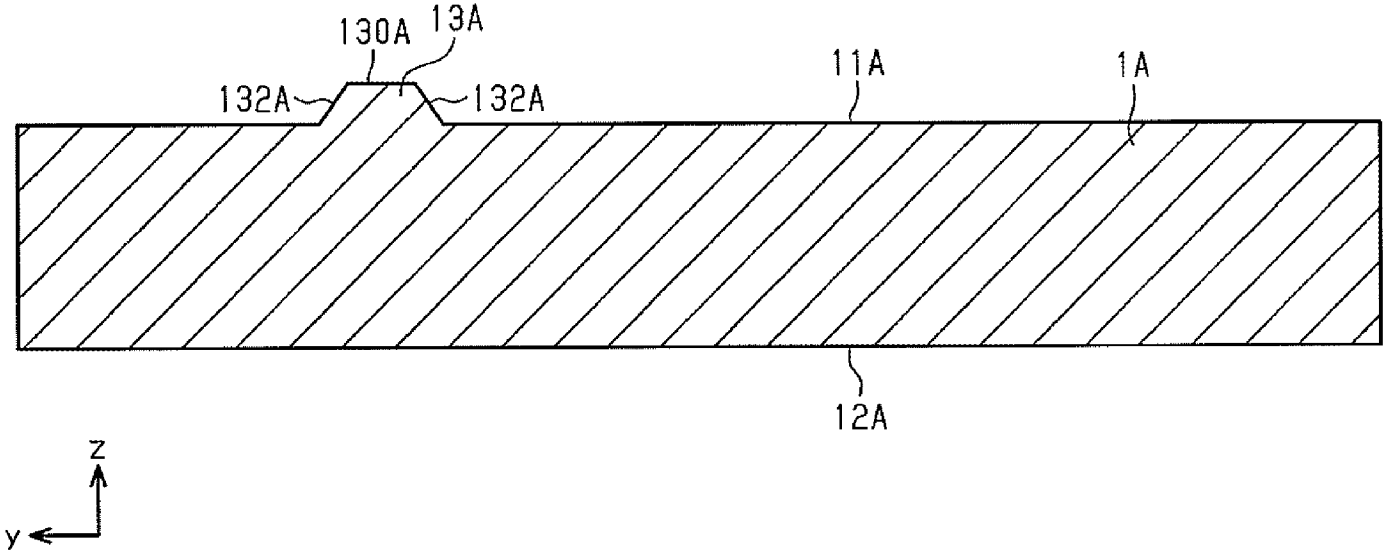
FIG. 8 is a cross-sectional diagram of a substrate material after implementing a first etching process.

As shown in FIG. 8, a substrate convex portion 13A protruding from the first surface 11A is formed on the substrate material 1A by anisotropic etching using KOH. At this point in time, the first surface 11A is an etched surface. The substrate convex portion 13A is formed in an elongated manner of extending in the main scan direction x.

The substrate convex portion 13A has a substrate top surface 130A which is a surface parallel to the first surface 11A. In the first embodiment, the substrate top surface 130A is a (100) surface. In the first embodiment, the etched first surface 11A is a (100) surface.

The substrate convex portion 13A includes a substrate inclining surface 132A. The substrate inclining surface 132A is a surface connected to the substrate top surface 130A and the first surface 11A in the sub scan direction y.

The substrate convex portion 13A of the first embodiment has two substrate inclining surfaces 132A. The two substrate inclining surfaces 132A are located on positions spaced by the substrate top surface 130A in the sub scan direction y. The substrate inclining surfaces 132A are connected to the substrate top surface 130A and the first surface 11A. The substrate inclining surfaces 132A are surfaces inclining relative to the substrate top surface 130A and the first surface 11A.

Figure 9:
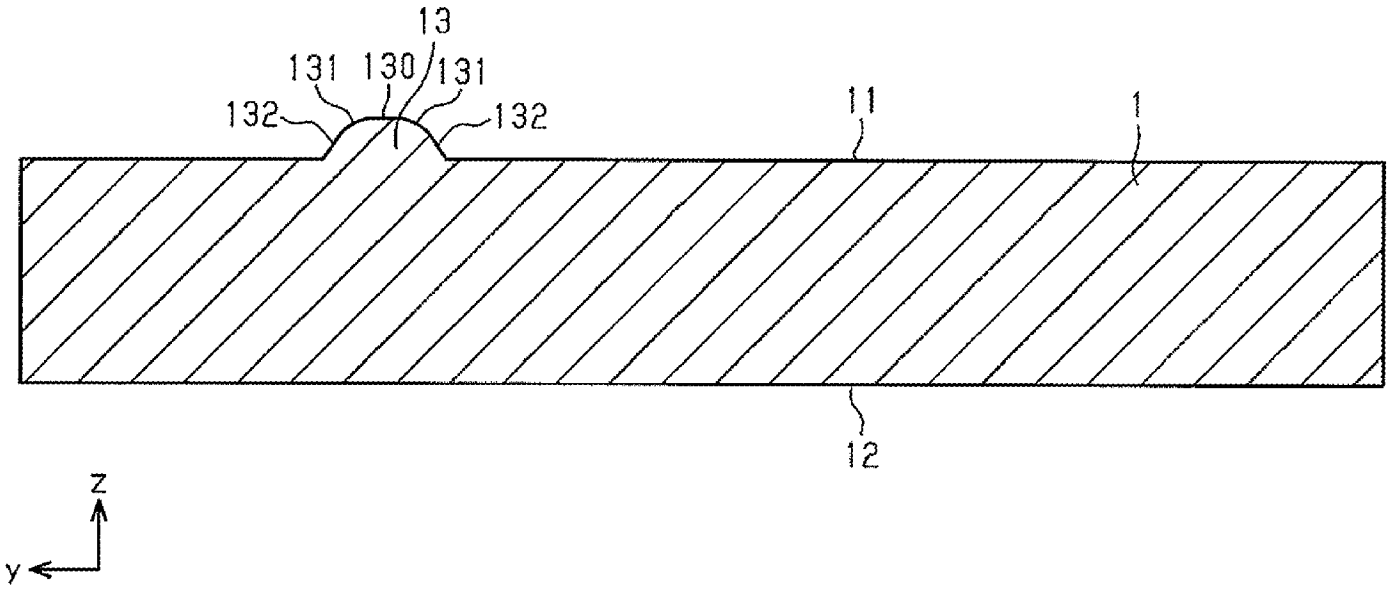
FIG. 9 is a cross-sectional diagram of a substrate after implementing a second etching process.

As shown in FIG. 9, the mask layer is removed, and the curving surface 131 is formed by etching using TMAH. TMAH is tetramethylammonium hydroxide. In the first embodiment, an aqueous or methanol solution with a TMAH concentration of equal to or more than 20% and equal to or less than 30% is used. In FIG. 9, the top surface 130 is a portion where the substrate top surface 130A is formed. The inclining surface 132 is a portion where the substrate inclining surface 132A is formed. The curving surface 131 is a portion that is the border portion between the substrate top surface 130A and the substrate inclining surface 132A and has been etched using TMAH. The first main surface 11 of the substrate 1 is the first surface 11A of the substrate material 1A, and the first back surface 12 of the substrate 1 is the second surface 12A of the substrate material 1A.

That is to say, the method for manufacturing the thermal print head 1A includes a first step and a second step serving as a convex portion formation step, wherein the first step performs anisotropic etching using KOH on the substrate material 1A to form the inclining surface 132, and the second step performs anisotropic etching using TMAH on the substrate material 1A having the substrate inclining surface 132A to form the curving surface 131. As such, anisotropic etching is implemented twice on the substrate material 1A in FIG. 7 to form the substrate 1 including the convex portion 13 as shown in FIG. 9.

Figure 11:
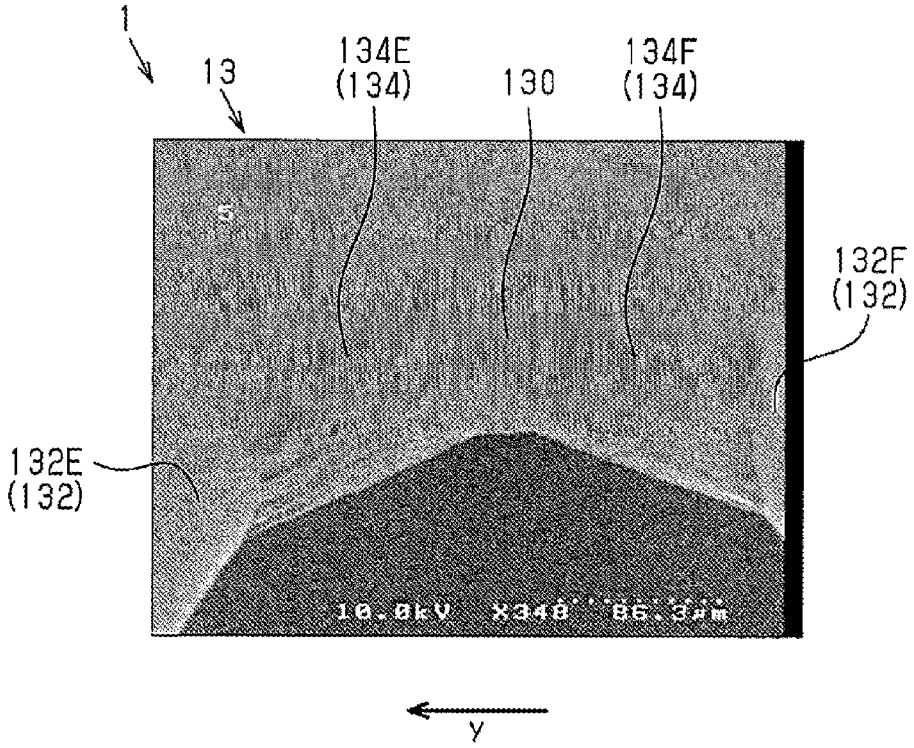
FIG. 11 is a cross-sectional diagram of a substrate after implementing etching using potassium hydroxide (KOH)

Furthermore, as a comparison example, an image of the convex portion 13 when anisotropic etching using KOH is implemented on the substrate material 1A (referring to FIG. 8 for both) on which the substrate convex portion 13A is formed is shown in FIG. 11. As shown in FIG. 1, if KOH instead of TMAH is used in the second anisotropic etching process, a sloped surface 134 instead of the curving surface 131 is formed on the substrate 1. That is to say, the sloped surface 134 is a portion of the border portion between the substrate top surface 130A and the substrate inclining surface 132A and having been etched using KOH. The sloped surface 134 is a surface connected to the top surface 130 and the inclining surface 132 in the sub scan direction y, and extends in a linear manner when viewing the substrate 1 from the main scan direction x. The angle of the sloped surface 134 relative to the first main surface 11 is different from the angle $\alpha 2$.

In the comparison example shown in FIG. 11, the convex portion 13 has two sloped surfaces 134. The two sloped surfaces 134 are located on positions spaced by the top surface 130 in the sub scan direction y. For illustration purposes, the sloped surface 134 located more downstream in the sub scan direction y than the top surface 130 is set as a first sloped surface 134E, and the sloped surface 134 located more upstream than the top surface 130 is set as a second sloped surface 134F. The first sloped surface 134E is connected to the top surface 130 and the first inclining surface 132E. The second sloped surface 134F is connected to the top surface 130 and the second inclining surface 132F. The angle formed by the sloped surface 134 relative to the first main surface 11 is equal to or less than the angle $\alpha 2$.

In the comparison example in FIG. 11, the convex portion 13 is an angular shape. That is to say, in the convex portion 13, angles are formed at the border portion between the top surface 130 and the sloped surface 134 and the border portion between the sloped surface 134 and the inclining surface 132. The surface of the sloped surface 134 formed by anisotropic etching using KOH is relatively rougher.

Figure 12:
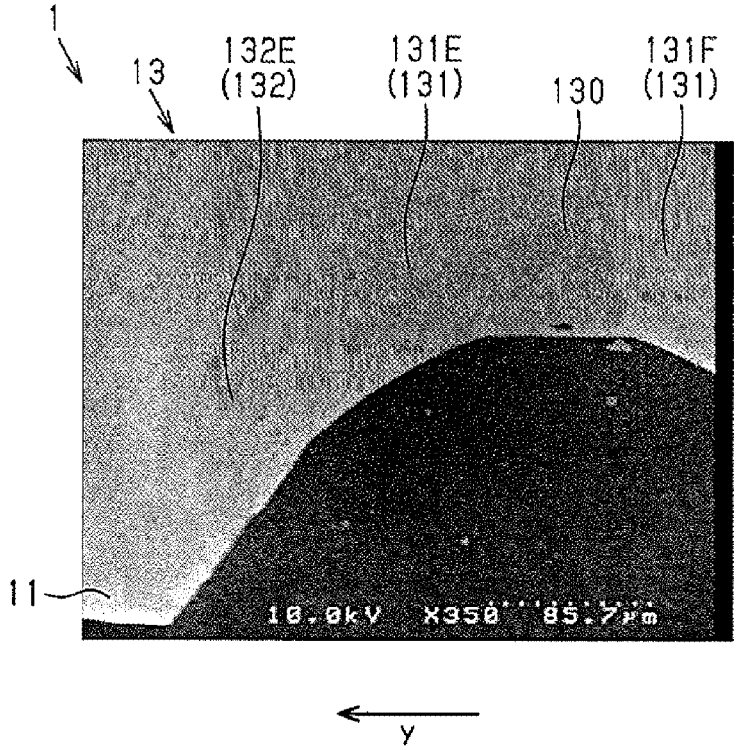
FIG. 12 is a cross-sectional diagram of a substrate after implementing etching using tetramethylammonium hydroxide (TMAH)

As shown in FIG. 12, if anisotropic etching using TMAH is implemented on the substrate material 1A where the substrate convex portion 13A (referring to FIG. 8 for both) is formed, the curving surface 131 is formed. That is to say, if TMAH is used in the second anisotropic etching process, the curving surface 131 is formed on the substrate 1. Thus, the convex portion 13 becomes a shape with an arc. The surface of the curving surface 131 formed by anisotropic etching using TMAH is relatively smoother.

As shown in FIG. 11 and FIG. 12, the surface roughness of the curving surface 131 is less than the surface roughness of the sloped surface 134. The surface roughness refers to, for example, arithmetic mean roughness. For example, the surface roughness of the curving surface 131 and the surface roughness of the sloped surface 134 may be measured by illuminating the curving surface 131 and the sloped surface 134 with laser beams. With the same method, the surface roughness of the inclining surface 132 may also be measured.

Particularly, the border portion between the inclining surface 132 and the curving surface 131 is smoother than the border portion between the sloped surface 134 and the inclining surface 132 of the comparison example. That is to say, the border portion between the curving surface 131 and the inclining surface 132 extends smoothly in the main scan direction x.

The substrate 1 may also be formed by implementing anisotropic etching using TMAH on the substrate 1A twice. That is to say, TMAH may also be used in the first anisotropic etching process. The inclining surface 132 may also be formed by using TMAH in substitution for KOH.

Next, an example of a method for manufacturing the thermal print head A1 is described below.

Figure 13:
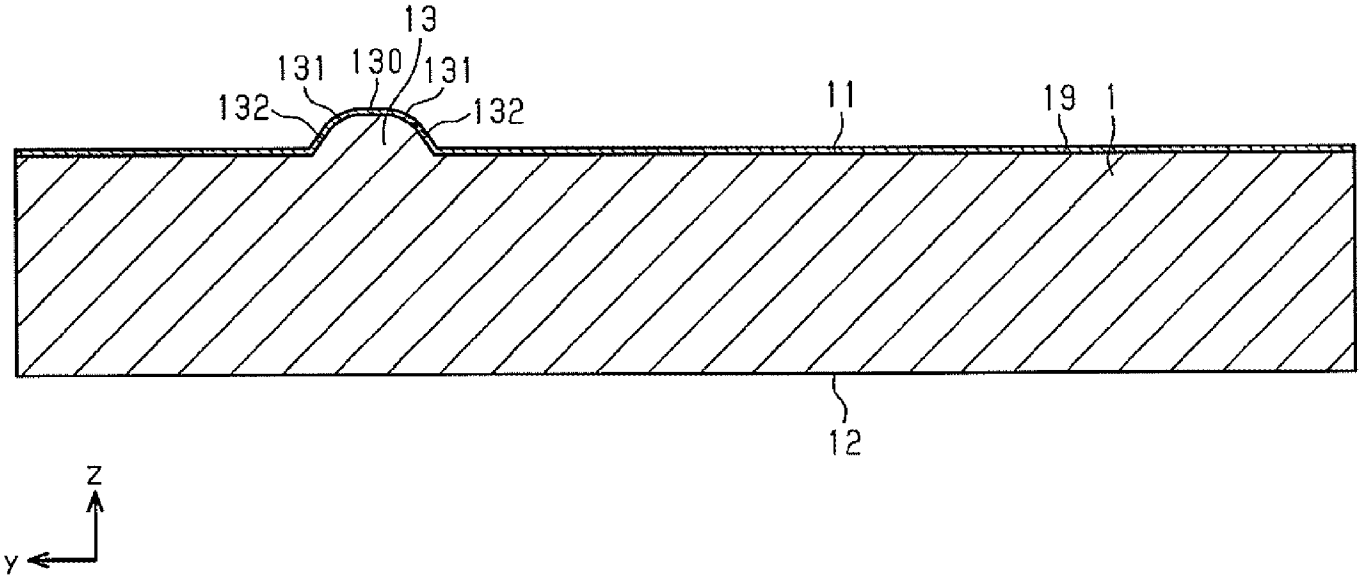
FIG. 13 is a cross-sectional diagram of a substrate having an insulating layer formed thereon.

As shown in FIG. 13, the insulating layer 19 is formed. For example, tetraethyl orthosilicate (TEOS) is deposited by means of chemical vapor deposition (CVD) on the substrate 1 to form the insulating layer 19.

Figure 14:
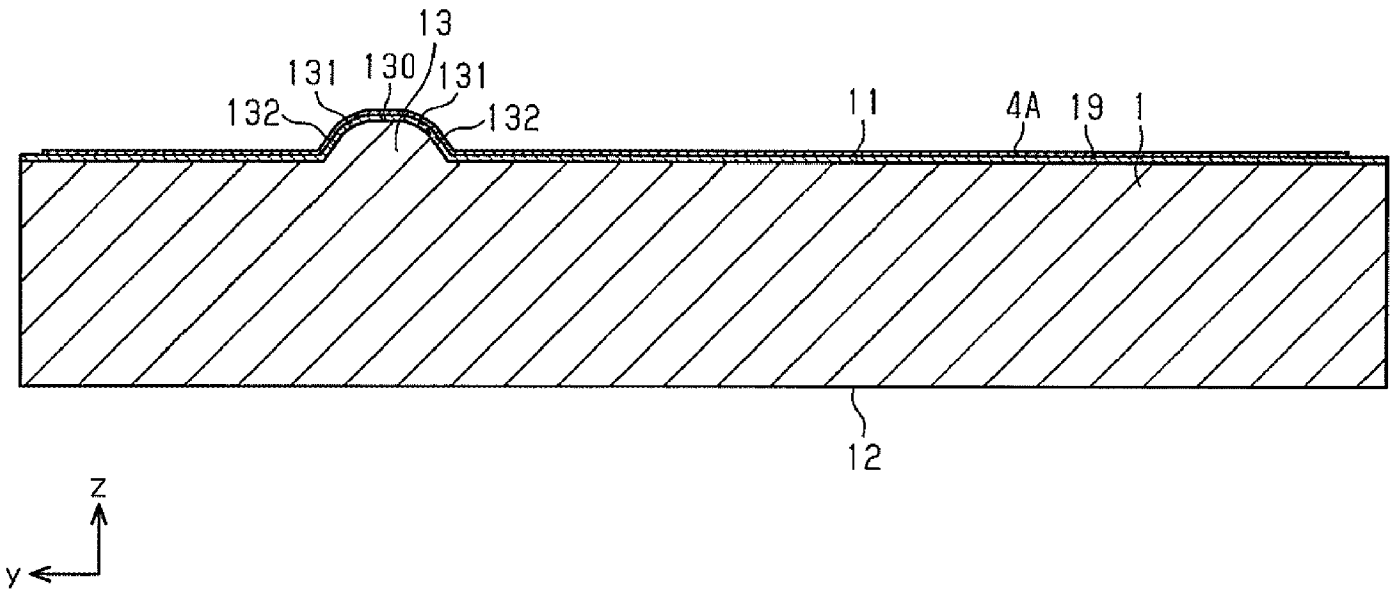
FIG. 14 is a cross-sectional diagram of a substrate having a resistor film formed thereon.

As shown in FIG. 14, a resistor film 4A is then formed. For example, a TaN film is formed on the insulating layer 19 by means of sputtering, hence forming the resistor film 4A. Furthermore, the resistor film 4A may also be a Si film.

Figure 15:
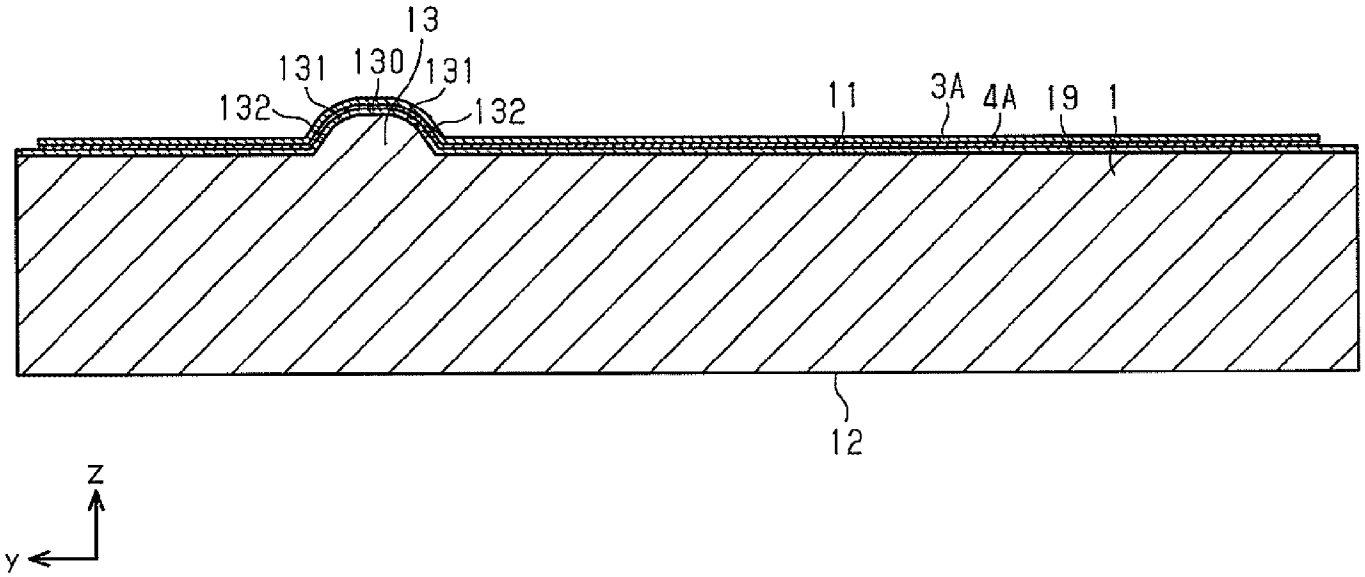
FIG. 15 is a cross-sectional diagram of a substrate having a wiring film formed thereon.

As shown in FIG. 15, next, a conductive film 3A is formed. For example, a Cu-containing layer is formed on the resistor film 4A by means of plating or sputtering, hence forming the conductive film 3A. If the conductive film 3A is formed, a Ti-containing layer may also be formed before forming the Cu-containing layer.

Figure 16:
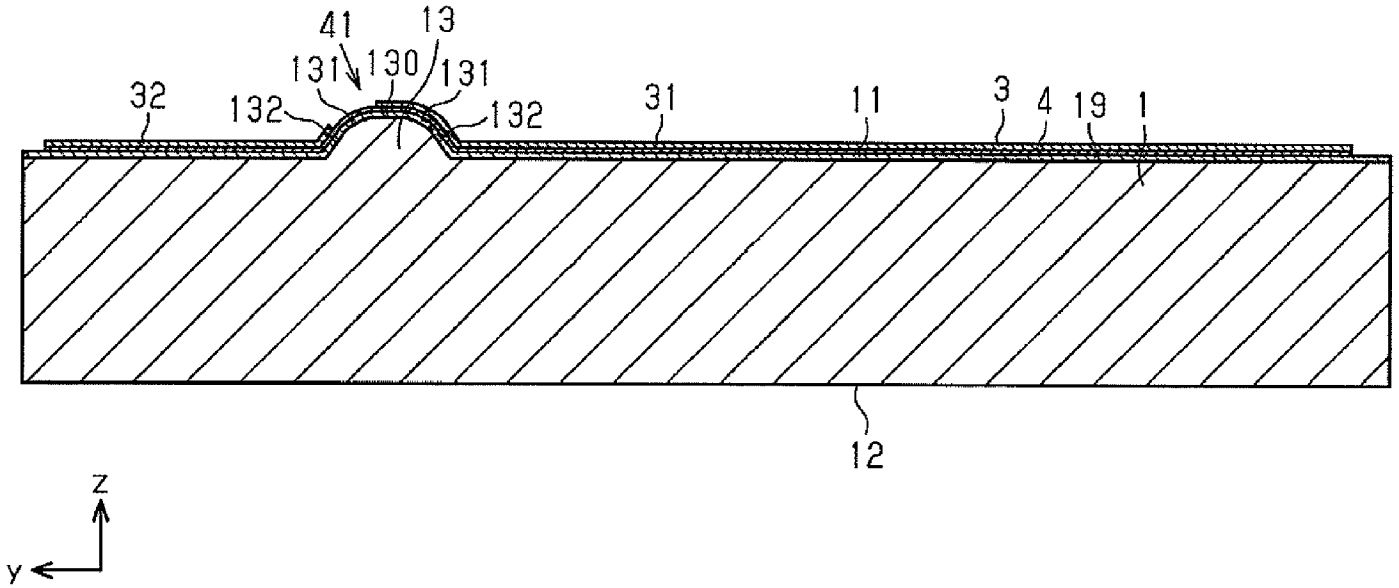
FIG. 16 is a cross-sectional diagram of a substrate having a wiring layer and a resistor layer formed thereon.
Figure 17:
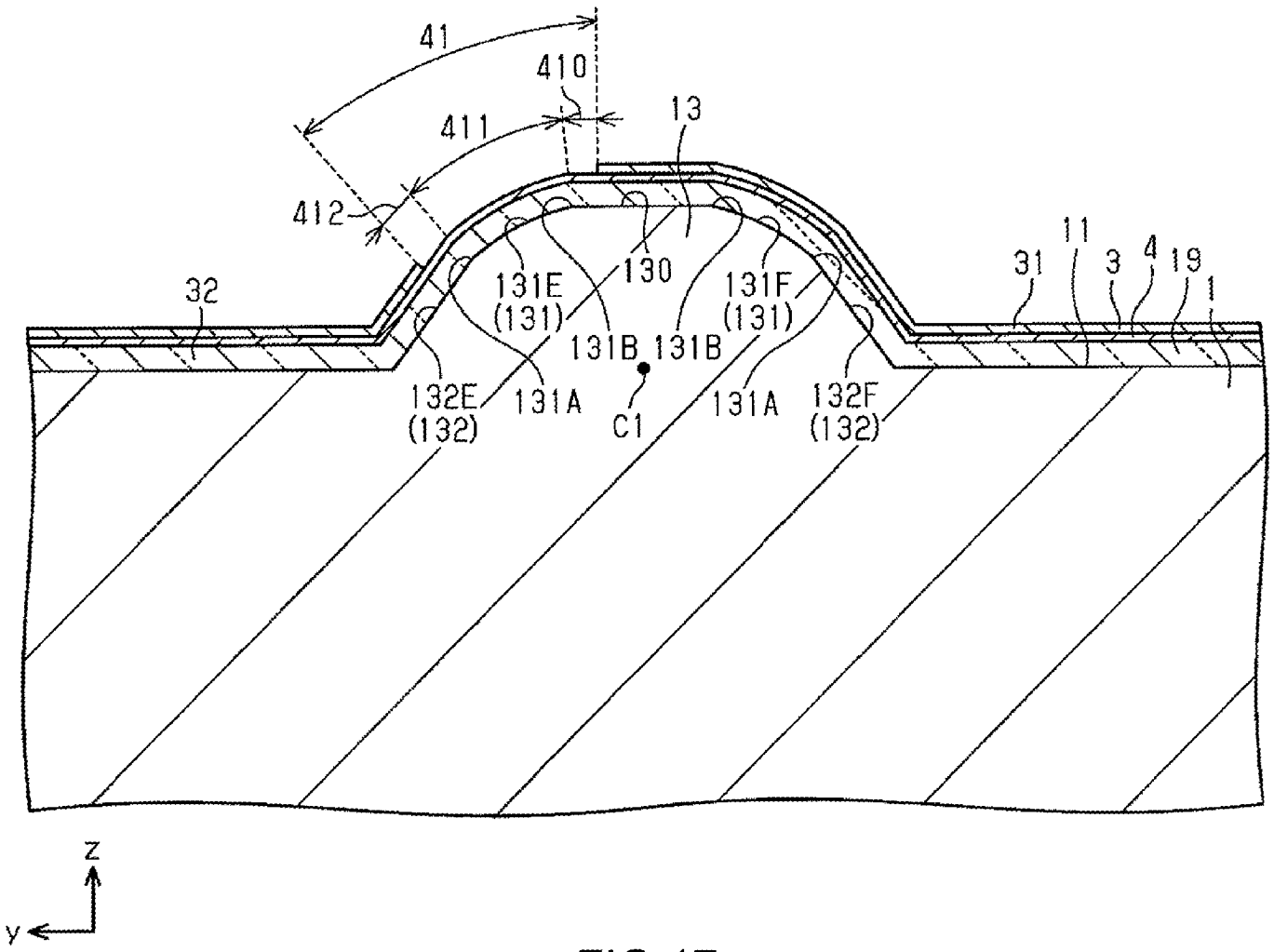
FIG. 17 is an enlarged diagram of FIG. 16.

As shown in FIG. 16 and FIG. 17, next, the wiring layer 3 and the resistor layer 4 are formed. The conductive film 3A is selectively etched and the resistor film 4A is selectively etched to form the wiring layer 3 and the resistor layer 4. At this point in time, the separating electrodes 31 and the common electrode 32 are formed in the wiring layer 3, and the heating portions 41 are formed in the resistor layer 4.

Next, the protective layer 2 is formed. For example, SiN and SiC are deposited on the insulating layer 19, the wiring layer 3 and the resistor layer 4 by means of CVD, hence forming the protective layer 2. The protective layer 2 is partially removed by such as etching, hence forming the pad opening 21.

The method for manufacturing the thermal print head A1 further includes a step of installing the substrate 1 having the protective layer 2 formed thereon to the first support surface 81, a step of installing the circuit substrate 5 to the second support surface 82, a step of disposing the driver integrated circuit 7 on the circuit substrate 5, a step of bonding the metal wire 61 and the metal wires 62, and a step of forming the protective resin 78. Thus, the thermal print head A1 is acquired by the described manufacturing method.

Effects of the first embodiment are described below.

The printing medium 99 is pressed toward the heating curving portion 411 by the platen roller 91 while being transported. That is to say, in the first embodiment, the mode of pressing the platen roller 91 toward the heating curving portion 411 requires that the two be positioned opposite to each other. In this case, the printing medium 99 is easily pressed by the platen roller 91 toward the heating curving portion 411 because the heating curving portion 411 is curved. Thus, even if the position of the platen roller 91 is shifted, the printing medium 99 is nonetheless easily pressed toward the heating curving portion 411.

In the printing medium 99, an area being clamped by the platen roller 91 and the thermal print head A1 is reduced since the heating curving portion 411 is curved, and hence friction generated between the thermal print head A1 and the printing medium 99 during transportation is also reduced. Furthermore, from the perspective that the printing medium 99 is pressed to the heating curving portion 411 with the protective layer 2 between the two, it is equivalent that friction generated between the printing medium 99 and the heating curving portion 411 is also reduced.

In the first embodiment, the heating portions 41 are disposed as crossing the top surface 130, the first curving surface 131E and the first inclining surface 132E. That is to say, the heating portions 41 are disposed on the convex portion 13 in a manner of being closer to the downstream in the sub scan direction y. Accordingly, for example, if the platen roller 91 is closer to the downstream in the sub scan direction y relative to the convex portion 13, the printing medium 99 may be easily pressed toward the heating portions 41, hence acquiring good printing quality.

If the platen roller 91 is located closer to the downstream in the sub scan direction y relative to the convex portion 13, the possibility of interference generated between the platen roller 91 and the protective resin 78 may be lowered. If the platen roller 91 is closer to the downstream in the sub scan direction y relative to the convex portion 13, the dimension of the substrate 1 in the sub scan direction y may be reduced. If the heating portions 41 are disposed on the convex portion 13 in a manner of being closer to the downstream in the sub scan direction y, the dimension of the heating portions 41 in the sub scan direction y may be reduced. By reducing the dimension of the heating portions 41 in the sub scan direction y, heat is centrally generated at the heating portions 41, and therefore good printing quality is achieved.

Effects of the first embodiment are described below.

(1-1) The printing medium 99 is easily pressed toward the heating curving portion 411 because the heating curving portion 411 is curved, and thus printing is better performed on the printing medium 99.

(1-2) The convex portion 13 has the top surface 130, the inclining surface 132 and the curving surface 131. In this case, the convex portion 13 becomes a shape with an arc on the basis of the curving surface 131, such that the heating portions 41 also become a shape with an arc as the convex portion 13, and thus the printing medium 99 may be easily pressed toward the heating curving portion 411. Furthermore, friction between the printing medium 99 and thermal print head A1 is reduced to thereby suppress wear of the printing medium 99.

(1-3) If the convex portion 13 is an angular shape, the angle of the convex portion 13 may become recessed in the platen roller 19. That is to say, if the printing medium 99 is pressed toward the heating portions 41 by the platen roller 91, the angle of the convex portion 13 may become recessed in the printing medium 99. In this case, the load imposed on the printing medium 99 is increased.

In regard to the issue above, in the convex portion 13 of the first embodiment, the border portion between the curving surface 131 and the inclining surface 132 is curved. Accordingly, if the convex portion 13 has an angle, the load imposed on the printing medium 99 as a result of the printing medium 99 pressing the angle may be mitigated. Furthermore, wear of the printing medium 99 is also suppressed.

(1-4) The border portion between the curving surface 131 and the inclining surface 132 is a smooth surface extending in the main scan direction x, and thus an offset in the resistance of the wiring layer 3 on the border portion between the curving surface 131 and the inclining surface 132 is mitigated.

Second Embodiment

A thermal print head according to the second embodiment is described below. In the second embodiment, configuration differences from the first embodiment are primarily explained. In the second embodiment, components identical to those of the first embodiment are represented by the same denotations as the first embodiment, and such repeated description is omitted herein.

Figure 18:
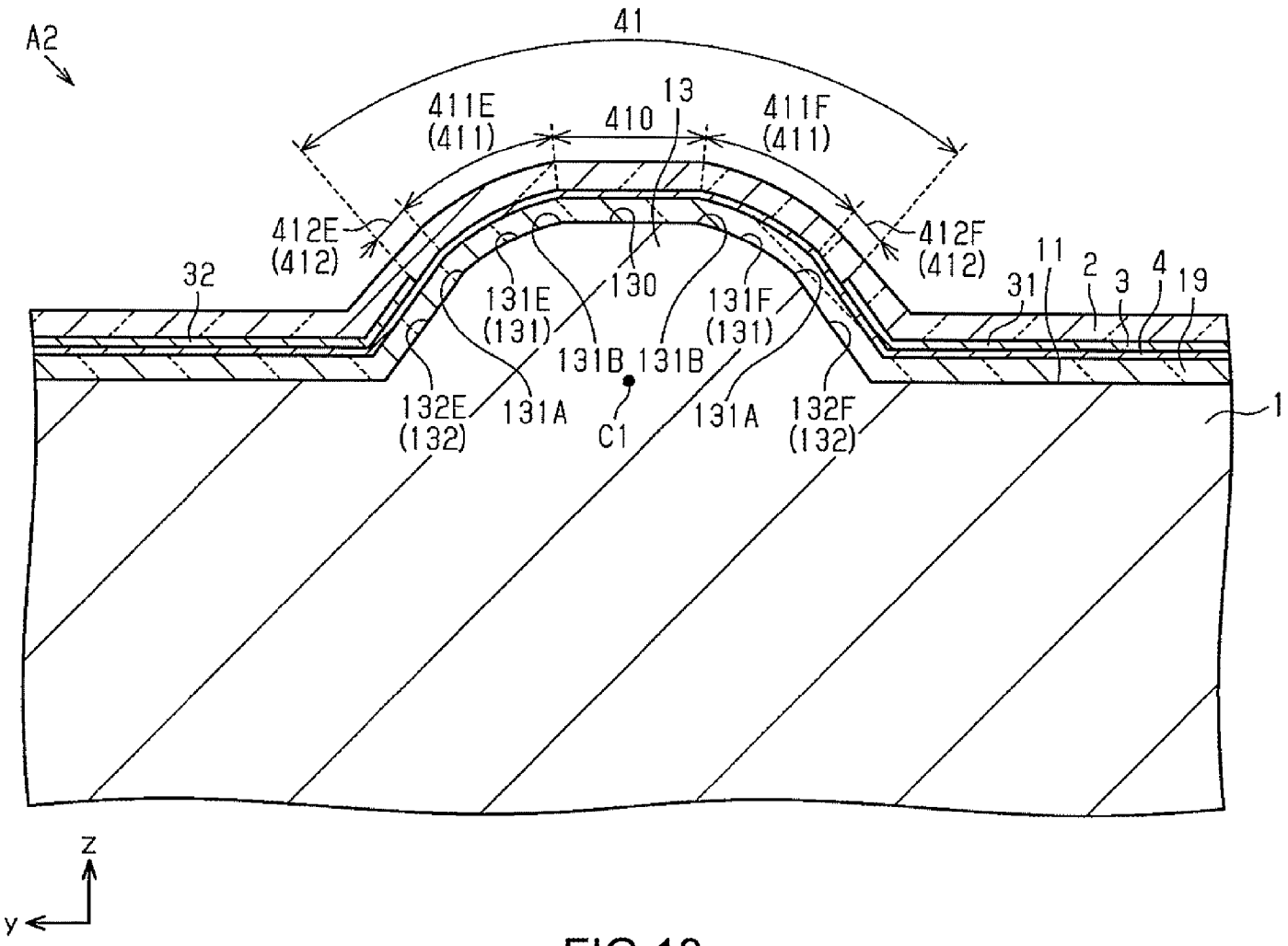
FIG. 18 is a cross-sectional diagram of a thermal print head according to a second embodiment.
Figure 19:
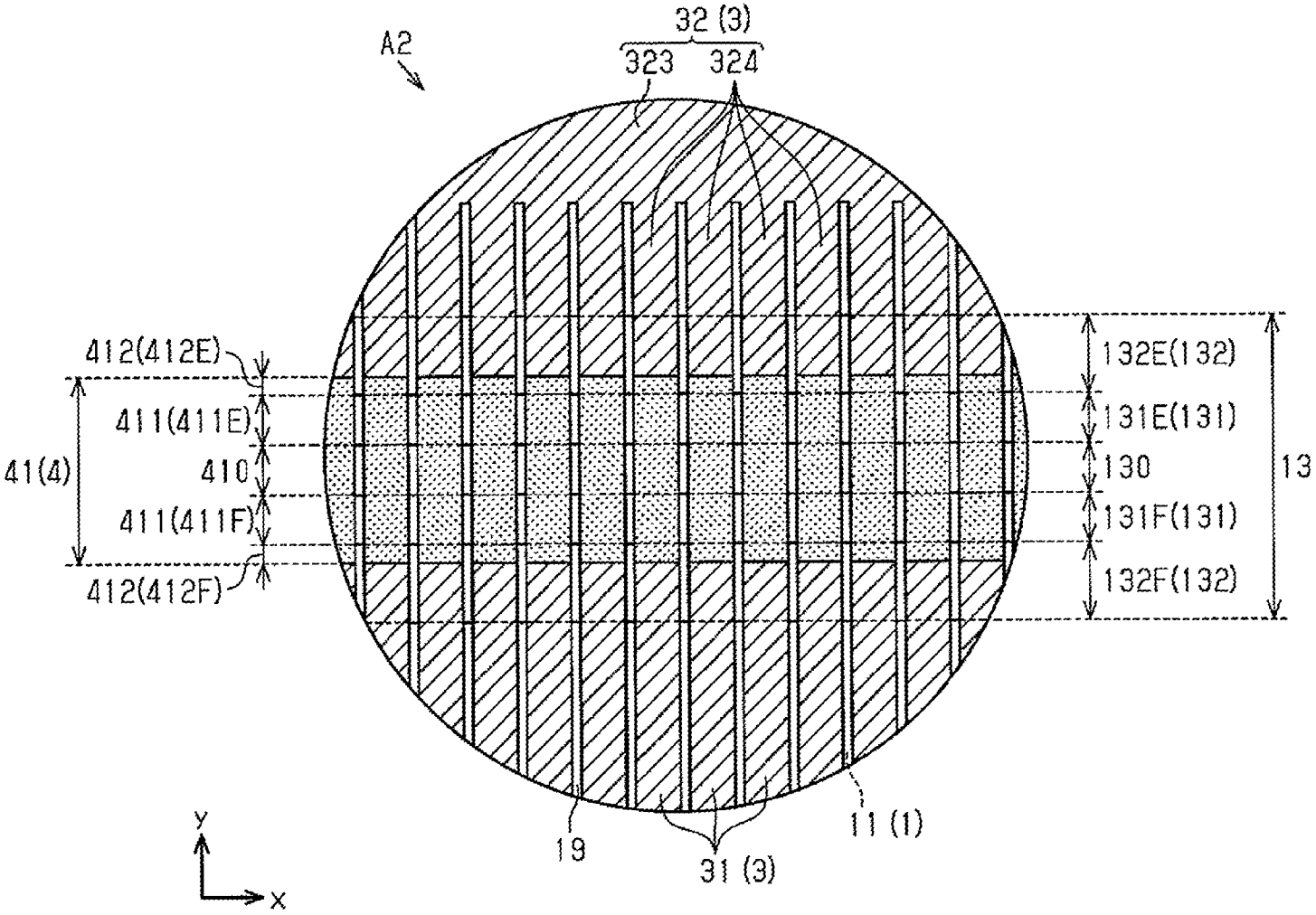
FIG. 19 is a top view of the thermal print head according to the second embodiment.

As shown in FIG. 18 and FIG. 19, in a thermal print head A2, in the sub scan direction y, the heating top portion 410 is arranged throughout the full length of the top surface 130. In the second embodiment, different from the first embodiment, the heating top portion 410 is disposed on the entire top surface 130 but not just a part of the top surface 130, when viewing the convex portion 13 from the main scan direction x.

In the second embodiment, each heating portion 41 includes two heating curving portions 411. The two heating curving portions 411 are located on positions spaced by the heating top portion 410 in the sub scan direction y. For illustration purposes, the heating curving portion 411 located closer to the downstream in the sub scan direction y than the heating top portion 410 is set as a first heating curving portion 411E, and the heating curving portion 411 located closer to the upstream than the heating top portion 410 is set as a second heating curving portion 411F.

In the heating portion 41, the first heating curving portion 411E is a portion formed on the first curving surface 131E. In the resistor layer 4, the first heating curving portion 411E is formed by a portion formed on the first curving surface 131E. The surface of the first heating curving portion 411E curves in a manner corresponding to the first curving surface 131E.

In the sub scan direction y, the first heating curving portion 411E is arranged throughout the full length of the first curving surface 131E. That is to say, the first heating curving portion 411E is disposed as crossing from the first end 131A to the second end 131B on the first curving surface 131E. Thus, the heating portion 41 of the second embodiment is disposed as crossing the top surface 130 and the first curving surface 131E on the convex portion 13. The heating portion 41 is disposed as crossing the border between the top surface 130 and the first curving surface 131E. The configuration of the first heating curving portion 411E of the second embodiment is identical to that of the heating curving portion 411 of the first embodiment.

The second heating curving portion 411F of the heating portion 41 is a portion formed on the second curving surface 131F. The second heating curving portion 411F and the heating top portion 410 are continuous. The second heating curving portion 411F is formed by a portion of the resistor layer 4 formed on the second curving surface 131F. The surface of the second heating curving portion 411F curves in a manner corresponding to the second curving surface 131F.

In the second embodiment, in the sub scan direction y, the second heating curving portion 411F is arranged throughout the full length of the second curving surface 131F. That is to say, the second heating curving portion 411F is disposed as crossing from the first end 131A to the second end 131B on the second curving surface 131F. Thus, the heating portion 41 of the second embodiment is disposed as crossing the top surface 130 and the second curving surface 131F on the convex portion 13. The heating portion 41 is disposed as crossing the border between the top surface 130 and the second curving surface 131F.

In the second embodiment, the heating portion 41 includes two heating inclining portions 412. The two heating inclining portions 412 are located on positions spaced by the heating top portion 410 in the sub scan direction y. For illustration purposes, the heating inclining portion 412 located closer to the downstream in the sub scan direction y than the heating top portion 410 is set as a first heating inclining portion 412E, and the heating inclining portion 412 located closer to the upstream than the heating top portion 410 is set as a second heating inclining portion 412F.

The first heating inclining portion 412E of the heating portion 41 is a portion formed on the first inclining surface 132E. The first heating inclining portion 412E is a part of a portion of the resistor layer 4 formed on the first curving surface 131E. The surface of the first heating inclining portion 412E inclines relative to the first main surface 11 in a manner corresponding to the first inclining surface 132E.

In the sub scan direction y, the first heating inclining portion 412E is disposed on a part of the first inclining surface 132E but is not disposed on the entire first inclining surface 132E. The first heating inclining portion 412E is disposed on the first inclining surface 132E on an end portion at the upstream in the sub scan direction y, and is not disposed on an end portion at the downstream in the sub scan direction y. Therefore, the heating portion 41 of the second embodiment is arranged on the convex portion 13 as crossing the first heating curving portion 411E and the first heating inclining portion 412E. The heating portion 41 is disposed as crossing the border between the first heating curving portion 411E and the first heating inclining portion 412E. The configuration of the first heating inclining portion 412E of the second embodiment is identical to that of the heating inclining portion 412 of the first embodiment.

The second heating inclining portion 412F of the heating portion 41 is a portion formed on the second inclining surface 132F. The second heating inclining portion 412F and the second heating curving portions 411F are continuous. The second heating inclining portion 412F is a part of a portion of the resistor layer 4 formed on the second inclining surface 132F. The surface of the second heating inclining portion 412F inclines relative to the first main surface 11 in a manner corresponding to the second inclining surface 132F.

In the sub scan direction y, the second heating inclining portion 412F is disposed on a part of the second inclining surface 132F but not disposed on the entire second inclining surface 132F. The second heating inclining portion 412F is disposed on the second inclining surface 132F on an end portion located at the downstream in the sub scan direction y, and is not disposed on an end portion located at the upstream in the sub scan direction y. Therefore, in the second embodiment, the heating portion 41 is disposed as crossing the second heating curving portion 411F and the second heating inclining portion 412F on the convex portion 13. The heating portion 41 is disposed as crossing the border between the second heating curving portion 411F and the second heating inclining portion 412F.

As described above, in the second embodiment, the heating portion 41 crosses from the end portion of the first inclining surface 132E located at the upstream in the sub scan direction y to the end portion of the second inclining surface 132F located at the downstream in the sub scan direction y. In the second embodiment, the heating portion 41 is disposed as being symmetric in the sub scan direction y by using the center of the convex portion 13 as a reference when viewing from the main scan direction x.

In the second embodiment, the wiring layer 3 includes a plurality of separating electrodes 31 and a common electrode 32. In the second embodiment, the separating electrodes 31 overlap a part of the second inclining surface 132F. That is to say, in the separating electrodes 31, the end portions located at the downstream in the sub scan direction y are arranged on positions overlapping the second inclining surface 132F. Thus, a part of the resistor layer 4 formed on the second inclining surface 132F is covered by the separating electrodes 31, and the rest forms the second heating inclining portion 412F.

The common electrode 32 includes a connecting portion 323 and a plurality of band portions 324. In the band portions 324, the end portion located at the upstream in the sub scan direction y is disposed on a position overlapping the first inclining surface 132E. Thus, a part of the resistor layer 4 formed on the first inclining surface 132E is covered by the band portions 324 of the common electrode 32, and the rest forms the first heating inclining portion 412E. The configuration of the common electrode 32 of the second embodiment is identical to that of the common electrode 32 of the first embodiment.

In addition to effects described above, the second embodiment further achieves the following effects.

(2-1) The heating portion 41 is disposed as crossing from the first inclining surface 132E to the second inclining surface 132F on the convex portion 13. Thus, even if the position of the platen roller 91 is shifted relative to the heating portions 41, the printing medium 99 may nonetheless be easily pressed toward the heating portion 41, hence acquiring stable printing quality. Particularly, in the second embodiment, the heating portion 41 is disposed as crossing from the top surface 130 to the second inclining surface 132F. That is to say, even if the platen roller 91 is located closer to the upstream in the sub scan direction y relative to the convex portion 13, stable printing quality is still easily acquired. As such, regardless of the position of the platen roller 91, stable printing quality is easily acquired according to the second embodiment. Therefore, for example, in cases of unexpected position shift of the platen roller 91 or the platen roller 91 of different diameters used, printing quality degradation may be minimized.

(2-2) The heating portion 41 is disposed to be symmetric in the sub scan direction y with respect to the center of the convex portion 13 as a reference. Therefore, the printing medium 99 may still be easily pressed toward the heating portion 41 in case of position shift of the platen roller 91, hence easily acquiring stable printing quality.

(2-3) The convex portion 13 has two curving surfaces 131, and so it is easier to press the printing medium 99 toward the heating curving portions 411 by the platen roller 91. Thus, the printing medium 99 may still be easily pressed toward the heating curving portions 411 even in the case of position shift of the platen roller 91.

(2-4) The convex portion 13 becomes a shape with an arc on the basis of the first curving surface 131E and the second curving surface 131F. Accordingly, friction generated between the thermal print head A2 and the printing medium 99 during transportation is reduced. Particularly, friction generated between the protective layer 2 and the printing medium 99 is reduced.

(2-5) The common electrode 32 is located more downstream in the sub scan direction y than the heating portion 41. Thus, the separating electrodes 31 are located more upstream in the sub scan direction y than the heating portion 41, such that an arrangement spacing of the separating electrodes 31 may be reduced in the main scan direction x. That is to say, high precision printing is achieved.

Third Embodiment

A thermal print head according to a third embodiment is described below. In the third embodiment, configuration differences from the first embodiment and the second embodiment are primarily explained. In the third embodiment, components identical to those of the first embodiment and the second embodiment are represented by the same denotations as the first embodiment and the second embodiment, and such repeated description is omitted herein.

Figure 20:
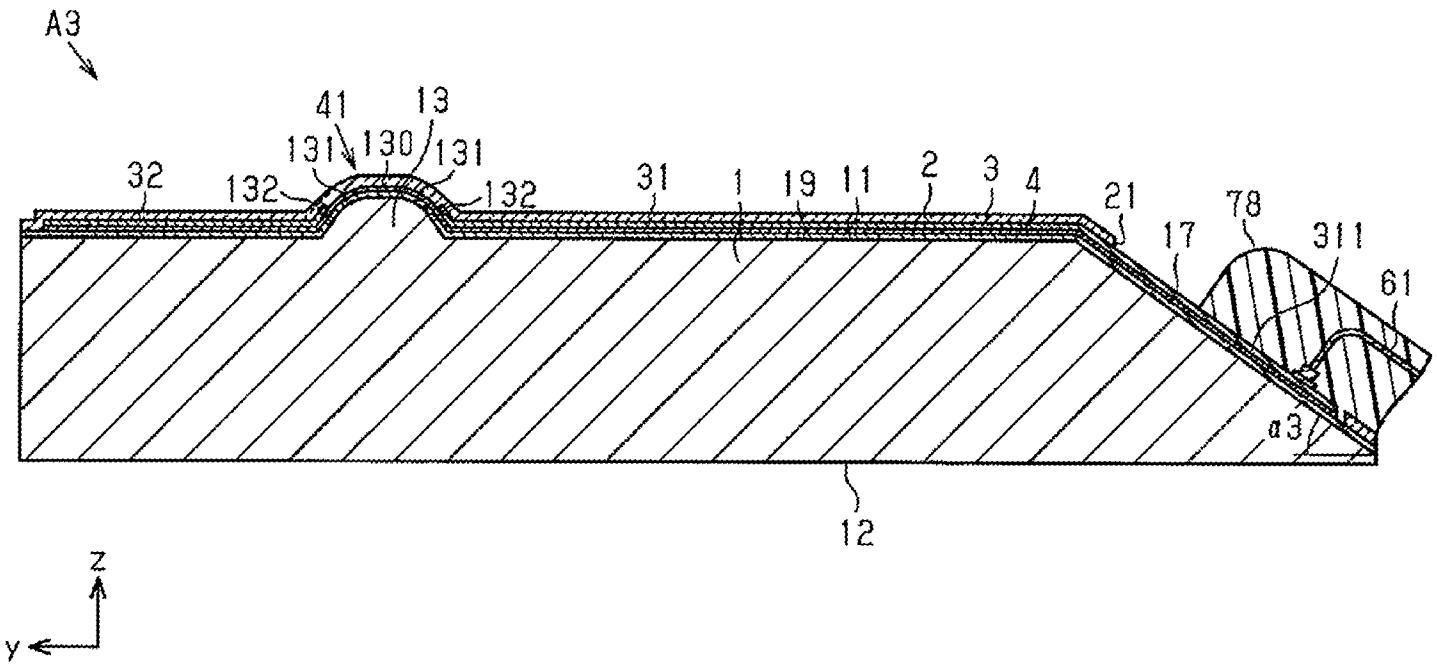
FIG. 20 is a cross-sectional diagram of a thermal print head according to a third embodiment.
Figure 21:
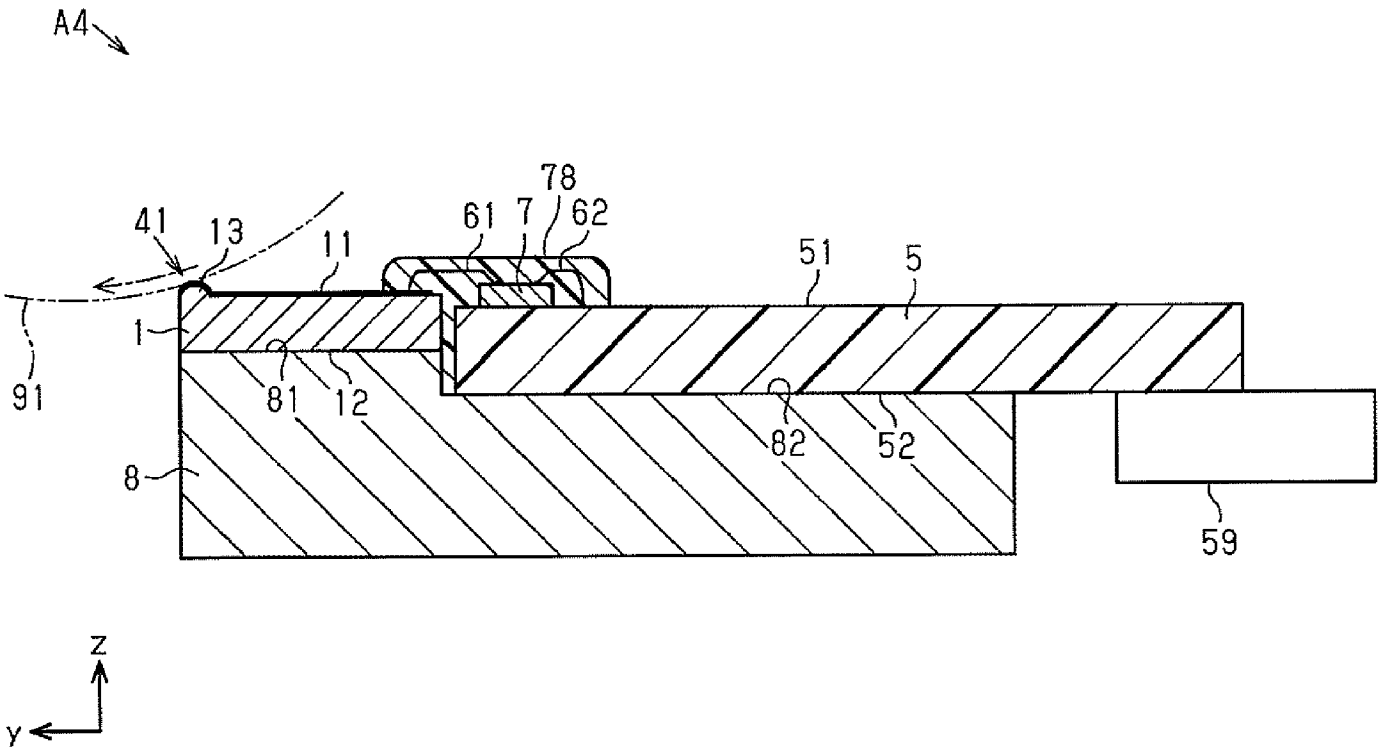
FIG. 21 is a cross-sectional diagram of a thermal print head according to a fourth embodiment.
Figure 22:
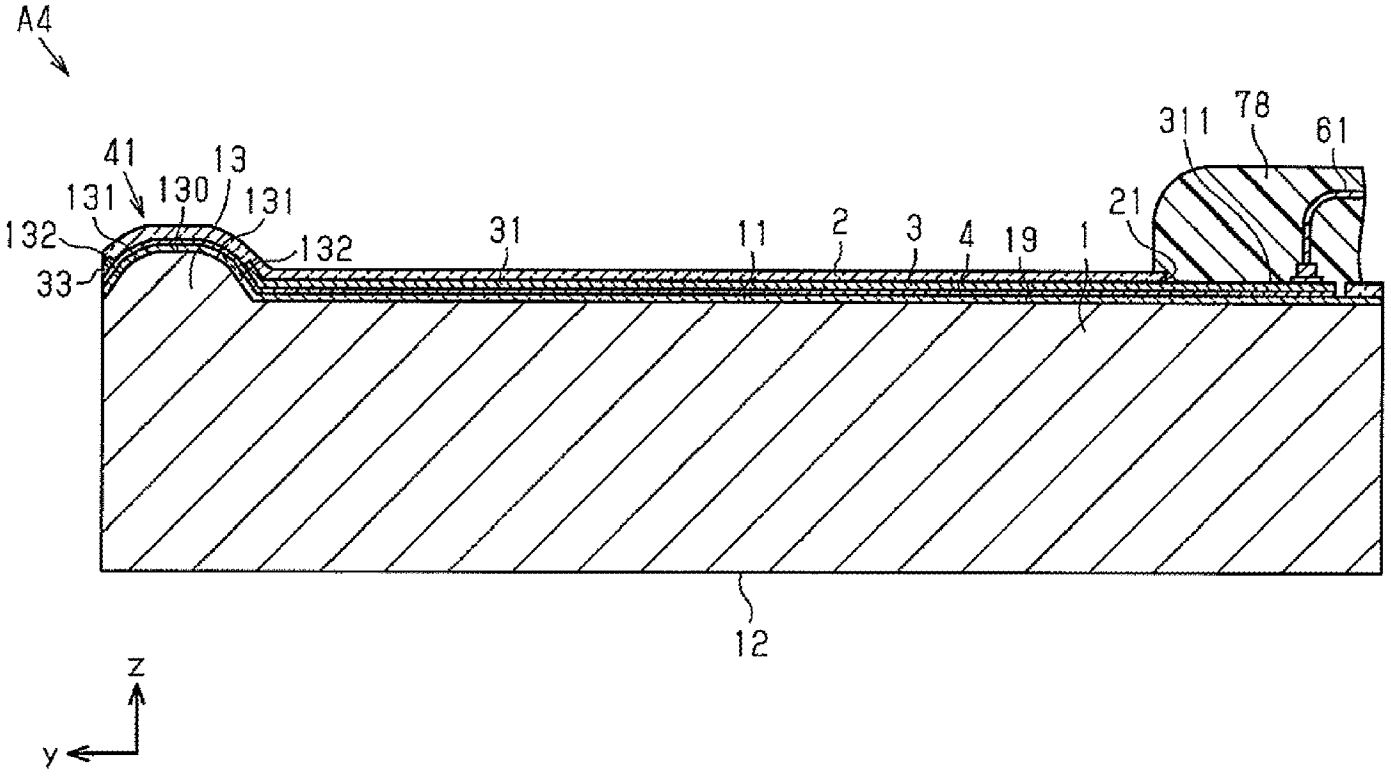
FIG. 22 is an enlarged diagram of FIG. 21.

As shown in FIG. 20, in a thermal print head A3, the substrate 1 has a connecting inclining surface 17. The connecting inclining surface 17 is located more upstream in the sub scan direction y than the convex portion 13. In the third embodiment, the connecting inclining surface 17 is disposed on the substrate 1 on an end portion located at the upstream in the sub scan direction y.

The connecting inclining surface 17 is a surface that inclines as the dimension of the substrate 1 decreases in the thickness direction z (that is, the thickness of the substrate 1) from the downstream to the upstream of the sub scan direction y. The connecting inclining surface 17 extends in a linear manner when viewing the substrate 1 in the main scan direction x.

An angle $\alpha$3 formed by the connecting inclining surface 17 and the first main surface 11 is, for example, equal to or more than 20 degrees and equal to or less than 60 degrees. In the third embodiment, the angle $\alpha$3 is, for example, 35 degrees. The angle $\alpha$3 may be modified by changing an etching liquid used for etching. The angle $\alpha$3 may also be equal to the angle $\alpha$2.

A separating pad 311 is provided at the connecting inclining surface 17. In the metal wire 61, a portion bonded with the separating pad 311, for example, a segment near the bonded portion, extends with respect to an inclining direction of the first main surface 11, that is, the normal direction of the connecting inclining surface 17.

In addition to effects described above, the third embodiment further achieves the following effects.

(3-1) The substrate 1 has the connecting inclining surface 17. For example, by disposing the separating pad 311 at the connecting inclining surface 17, the protective resin 78 covering the metal wire 61 is suppressed from significantly projecting from the substrate 1. As a result, interference generated between the protective resin 78 and the platen roller 91 may be mitigated.

Fourth Embodiment

A thermal print head according to a fourth embodiment is described below. In the fourth embodiment, configuration differences from the first embodiment to the third embodiment are primarily explained. In the fourth embodiment, components identical to those of the first embodiment to the third embodiment are represented by the same denotations as the first embodiment to the third embodiment, and such repeated description is omitted herein.

As shown in FIG. 21, FIG. 22, FIG. 23 and FIG. 24, in a thermal print head A4, the convex portion 13 is disposed on the substrate 1 on an end portion located at the downstream in the sub scan direction y. Thus, the substrate 1 of the fourth embodiment is closer to the downstream in the sub scan direction y than the convex portion 13 so as to be a configuration that does not possess the first main surface 11, or a configuration in which the first main surface 11 is smaller than that of any one of the thermal print heads A1, A2 and A3. In the examples shown in FIG. 21, FIG. 22, FIG. 23 and FIG. 24, the first main surface 11 does not exist on a position located more downstream in the sub scan direction y than the convex portion 13.

Figure 23:
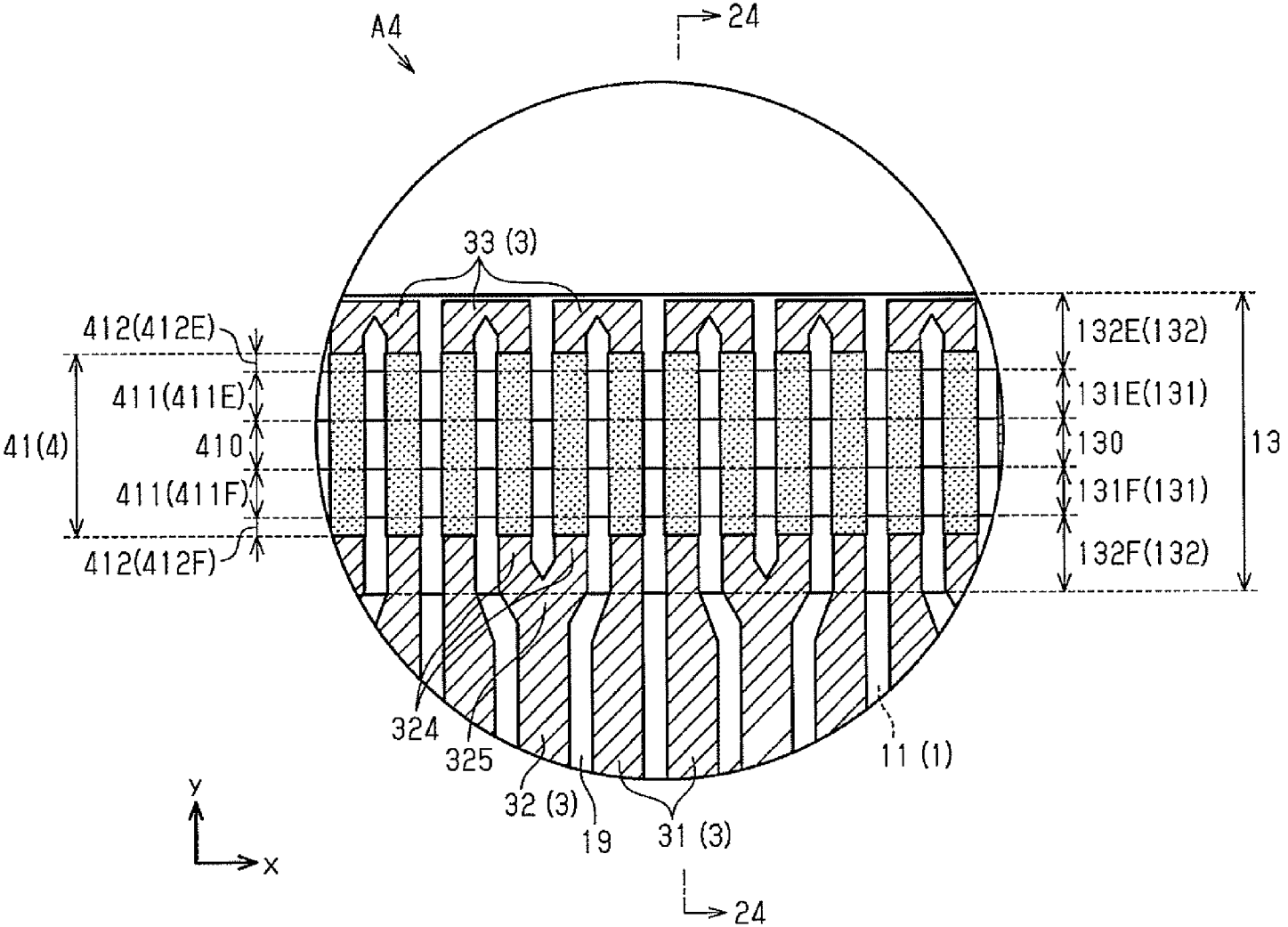
FIG. 23 is a top view of a thermal print head according to the fourth embodiment.
Figure 24:
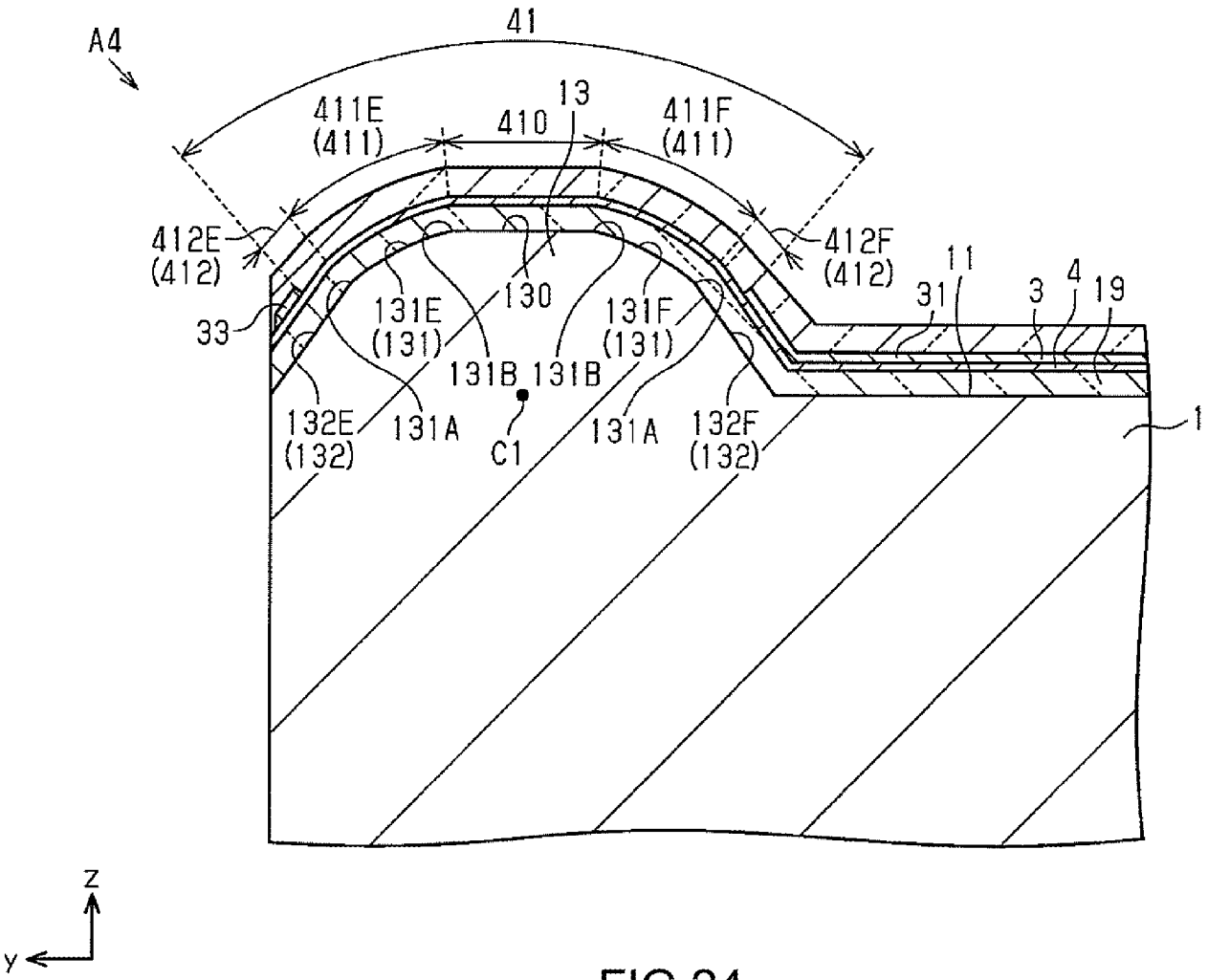
FIG. 24 is a cross-sectional diagram taken along line 24-24 in FIG. 23.

As shown in FIG. 23, in the fourth embodiment, the wiring layer 3 includes a plurality of separating electrodes 31, a plurality of common electrodes 32, and a plurality of relay electrodes 33. The separating electrodes 31 and the common electrodes 32 are disposed more upstream in the sub scan direction y than the heating portions 41. The plurality of separating electrodes 31 and the plurality of common electrodes 32 are arranged at predetermined intervals in the main scan direction x. The plurality of separating electrodes 31 and the plurality of common electrodes 32 are arranged in parallel.

In the separating electrodes 31, the end portions located at the downstream in the sub scan direction y are disposed on positions overlapping the second inclining surface 132F. The separating electrodes 31 are adjacent to the heating portions 41 in the sub scan direction y.

In the fourth embodiment, each common electrode 32 includes a band portion 324 and a branch portion 325. The band portion 324 is located more downstream in the sub scan direction y than the branch portion 325. The band portion 324 is provided as two in quantity. The two band portions 324 are connected to the branch portion 325, and extend in the sub scan direction y in a manner of being branched from the branch portion 325.

The band portions 324 are disposed on positions overlapping a part of the second inclining surface 132F. The two band portions 324 are adjacent to different heating portions 41 in the sub scan direction y. The common electrode 32 is adjacent to a heating portion 41 that is different from the heating portion 41 adjacent to the separating electrodes 31. As such, in the fourth embodiment, a part of the resistor layer 4 formed on the second inclining surface 132F is covered by the separating electrodes 31 and the band portions 324 of the common electrodes 32, and the rest becomes the second heating inclining portion 412F.

The relay electrodes 33 are disposed more downstream in the sub scan direction y than the heating portions 41. The plurality of relay electrodes 33 are arranged at predetermined intervals in the sub scan direction y. Each relay electrode 33 extends and returns in the sub scan direction y in a U-shape.

The relay electrodes 33 are located on positions only overlapping the first inclining surface 132E with respect to the convex portion 13. In the relay electrodes 33, end portions located at the upstream in the sub scan direction y are disposed on positions overlapping the first inclining surface 132E. Thus, a part of the resistor layer 4 formed on the first inclining surface 132E is covered by the relay electrodes 33, and the rest forms the first inclining portion 412E.

The relay electrodes 33 are adjacent to two heating portions 41 in the sub scan direction y. More specifically, each relay electrode 33 is adjacent to the heating portion 41 adjacent to the band portion 324 and the heating portion 41 adjacent to the common electrode 32 in the sub scan direction y. Thus, in the fourth embodiment, two heating portions 41, including the heating portion 41 located between the separating electrode 31 and the relay electrode 33 in the sub scan direction y and the heating portion 41 located between the common electrode 32 and the relay electrode 33 in the sub scan direction y, are present.

In the fourth embodiment, one common electrode 32, two relay electrodes 33 and two separating electrodes 31 form two charging paths. By supplying power to any one of the two separating electrodes 31, two heating portions 41 adjacent to each other in the main scan direction x may be powered. In the fourth embodiment, the configuration of the heating portions 41 is identical to that of the second embodiment.

In addition to effects described above, the fourth embodiment further achieves the following effects.

(4-1) The convex portion 13 is disposed on the substrate 1 on an end portion located at the downstream in the sub scan direction y. For example, if the platen roller 91 is closer to the downstream in the sub scan direction y than the convex portion 13, interference generated between the platen roller 91 and the substrate 1 may be further mitigated.

Fifth Embodiment

A thermal print head according to a fifth embodiment is described below. In the fifth embodiment, configuration differences from the first embodiment to the fourth embodiment are primarily explained. In the fifth embodiment, components identical to those of the first embodiment to the fourth embodiment are represented by the same denotations as the first embodiment to fourth embodiment, and such repeated description is omitted herein.

Figure 25:
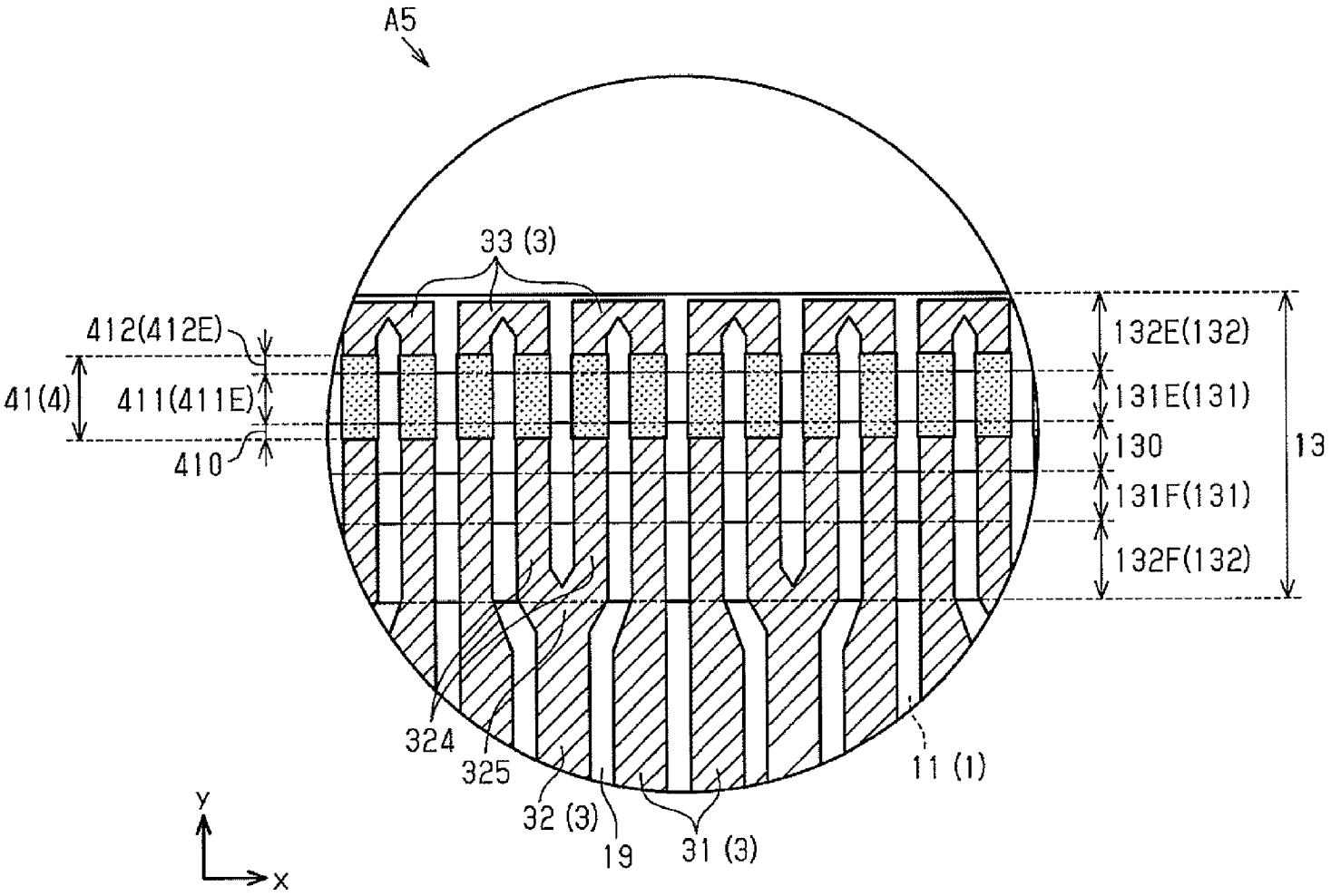
FIG. 25 is a top view of a thermal print head according to a fifth embodiment.

As shown in FIG. 25, in a thermal print head A5, similar to the fourth embodiment, the wiring layer 3 includes a plurality of separating electrodes 31, a plurality of common electrodes 32, and a plurality of relay electrodes 33. The separating electrodes 31 are formed on a portion corresponding to the second inclining surface 132F and the second curving surface 131F. The separating electrodes 31 extend from the second curving surface 131F toward a downstream side in the sub scan direction y, and overlap with a part of the top surface 130. Thus, in the separating electrodes 31, end portions located at the downstream in the sub scan direction y are disposed on positions overlapping the top surface 130.

In the fifth embodiment, each common electrode 32 includes a band portion 324 and a branch portion 325. The band portion 324 is located more downstream in the sub scan direction y than the branch portion 325. The band portion 324 is provided as two in quantity. The two band portions 324 are connected to the branch portion 325, and extend in the sub scan direction y in a manner of being branched from the branch portion 325.

The band portions 324 overlap a part of the second inclining surface 132F. The two band portions 324 are adjacent to different heating portions 41 in the sub scan direction y, respectively. The common electrode 32 is adjacent to the heating portion 41 that is different from the heating portion 41 adjacent to the separating electrode 31. As such, in the fifth embodiment, a part of the resistor layer 4 formed on the top surface 130 is covered by the separating electrodes 31 and the band portions 324 of the common electrodes 32, and the rest forms the heating top portion 410.

In addition to effects described above, the fifth embodiment further achieves the following effects.

(5-1) The convex portion 13 is disposed on the substrate 1 on an end portion located at the downstream in the sub scan direction y. Furthermore, the heating portions 41 are disposed as being closer to the downstream in the sub scan direction y on the convex portion 13. As such, if the platen roller 91 is closer to the downstream in the sub scan direction y than the convex portion 13, interference generated between the platen roller 91 and the substrate 1 may be mitigated, hence acquiring good printing quality.

Sixth Embodiment

A thermal print head according to a sixth embodiment is described below. In the sixth embodiment, configuration differences from the first embodiment to the fifth embodiment are primarily explained. In the sixth embodiment, components identical to those of the first embodiment to the fifth embodiment are represented by the same denotations as the first embodiment to the fifth embodiment, and such repeated description is omitted herein.

Figure 26:
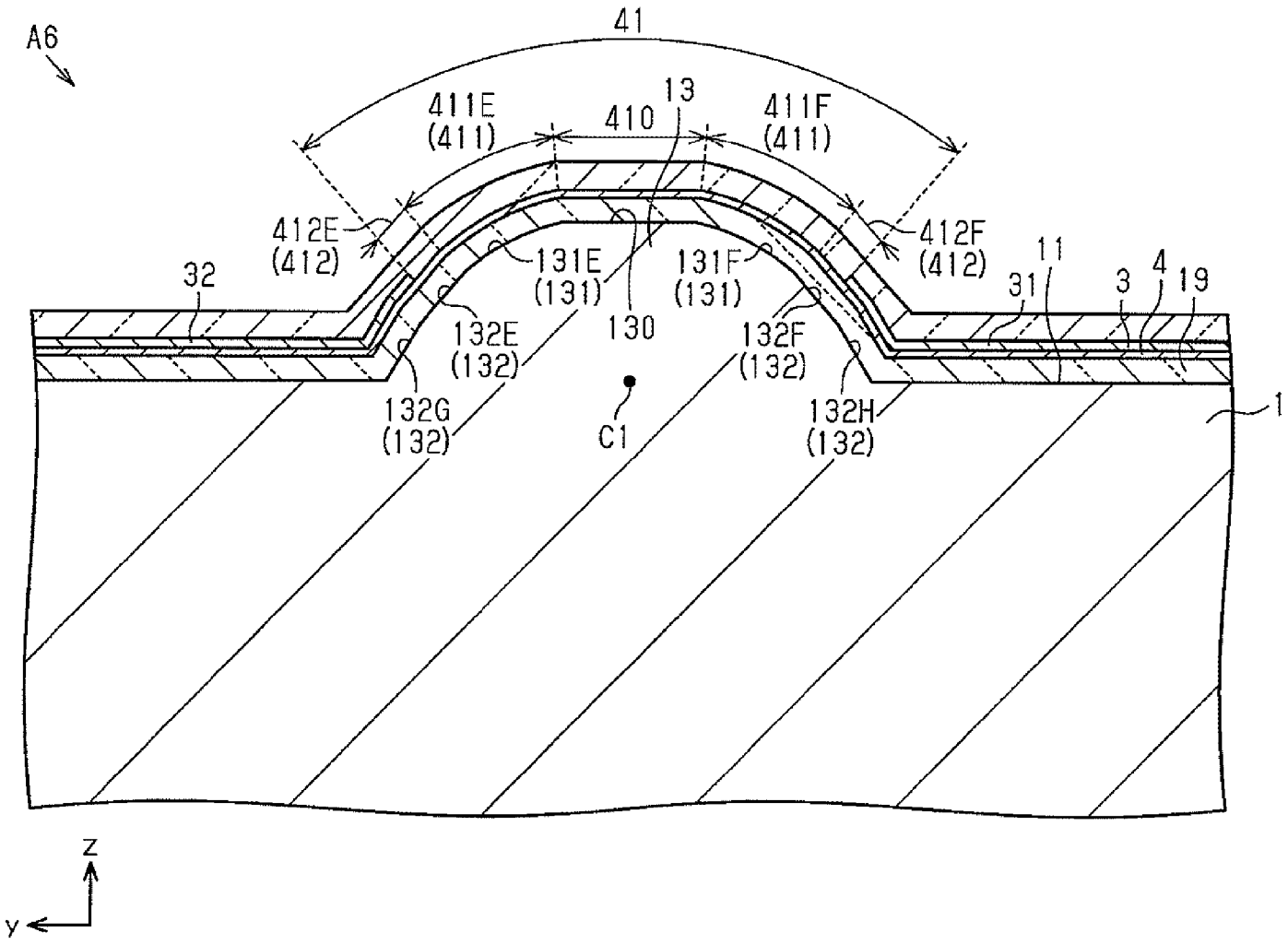
FIG. 26 is a cross-sectional diagram of a thermal print head according to a sixth embodiment.

As shown in FIG. 26, in a thermal print head A6, the convex portion 13 has one top surface 130, two curving surfaces 131 and four inclining surfaces 132. The configurations of the top surface 130 and the curving surfaces 131 are identical to those of the first embodiment. Among the four inclining surfaces 132, two inclining surfaces 132 are located more downstream in the sub scan direction y than the top surface 130, and the two remaining inclining surfaces 132 are located more upstream in the sub scan direction y than the top surface 130.

In the sixth embodiment, the convex portion 13 further has two inclining surfaces 132 in addition to the first inclining surface 132E and the second inclining surface 132F. For illustration purposes, the inclining surface 132 located more downstream in the sub scan direction y than the first inclining surface 132E is set as a third inclining surface 132G, and the inclining surface 132 located more upstream than the second inclining surface 132F is set as a fourth inclining surface 132H.

The third inclining surface 132G is located between the first main surface 11 and the first inclining surface 132E in the sub scan direction y. The third inclining surface 132G is a surface connected to the first main surface 11 and the first inclining surface 132E. In the third inclining surface 132G, an end portion located at the downstream in the sub scan direction y is connected to the first main surface 11, and an end portion located at the upstream in the sub scan direction y is connected to the first inclining surface 132E.

The fourth inclining surface 132H is located between the first main surface 11 and the second inclining surface 132F in the sub scan direction y. The fourth inclining surface 132H is a surface connected to the first main surface 11 and the second inclining surface 132F. In the fourth inclining surface 132H, an end portion located at the downstream in the sub scan direction y is connected to the main surface 11, and an end portion located at the upstream in the sub scan direction y is connected to the second inclining surface 132F. The third inclining surface 132G and the fourth inclining surface 132H incline in a manner of gradually approaching each other in a direction away from the first main surface 11.

In the sixth embodiment, an angle formed by the third inclining surface 132G and the first main surface 11 is equal to an angle formed by the fourth inclining surface 132H and the first main surface 11. The angle formed by the third inclining surface 132G and the first main surface 11 and the angle formed by the fourth inclining surface 132H and the first main surface 11 are larger than the angle formed by the first inclining surface 132E and the first main surface 11 and the angle formed by the second inclining surface 132F and the first main surface 11.

The separating electrodes 31 are disposed as crossing the second inclining surface 132F and the fourth inclining surface 132H on the convex portion 13. The common electrodes 32 are disposed as crossing the first inclining surface 132E and the third inclining surface 132G on the convex portion 13. Thus, the heating portion 41 is disposed as crossing from the first inclining surface 132E to the second inclining surface 132F on the convex portion 13. The configuration of the heating portion 41 is identical to that of the second embodiment.

In addition to effects described above, the sixth embodiment further achieves the following effects.

(6-1) The convex portion 13 has four inclining surfaces 132. Thus, compared to the configuration of having two inclining surfaces 132, the convex portion 13 is further formed of a shape with an arc when viewing from the main scan direction x. Therefore, wear generated in the printing medium 99 that is pressed by the platen roller 91 toward the heating portions 41 may be further suppressed.

Seventh Embodiment

A thermal print head according to a seventh embodiment is described below. In the seventh embodiment, configuration differences from the first embodiment to the sixth embodiment are primarily explained. In the seventh embodiment, components identical to those of the first embodiment to the sixth embodiment are represented by the same denotations as the first embodiment to the sixth embodiment, and such repeated description is omitted herein.

Figure 27:
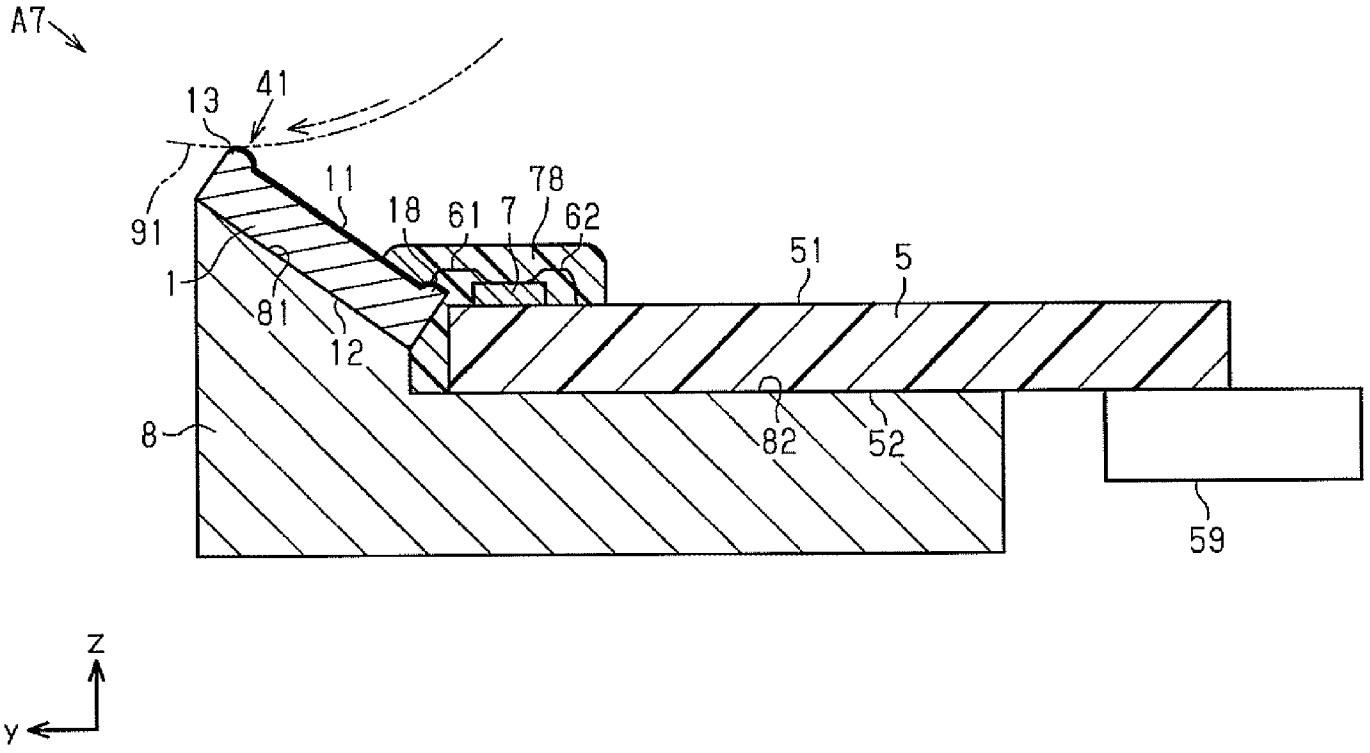
FIG. 27 is a cross-sectional diagram of a thermal print head according to a seventh embodiment.

As shown in FIG. 27, in a thermal print head A7, the substrate 1 is disposed in a manner of inclining relative to the circuit substrate 5. That is to say, in the seventh embodiment, the substrate 1 is not parallel to the circuit substrate 5. In the seventh embodiment, the substrate 1 and the circuit substrate 5 are arranged by way of having an angle between the first main surface 11 and the second main surface 51 become an obtuse angle.

Comparing the heat dissipation member 8 of the seventh embodiment with the heat dissipation member 8 of the first embodiment, the first support surface 81 is configured as inclining relative to the second support surface 82. In the seventh embodiment, the first support surface 81 and the second support surface 82 are arranged in a manner that the angle between the first support surface 81 and the second support surface 82 becomes an obtuse angle. Given that the heat dissipation member 8 is placed horizontally, the first support surface 81 inclines toward the downstream in the sub scan direction y by a rising slope.

The configuration of the substrate 1 of the seventh embodiment is identical to those of the fourth embodiment and the fifth embodiment. That is to say, the convex portion 13 is disposed on the substrate 1 on an end portion located at the downstream in the sub scan direction y. Thus, in the seventh embodiment, given that the heat dissipation member 8 is placed horizontally, the convex portion 13 is located at a highest position.

Figure 28:
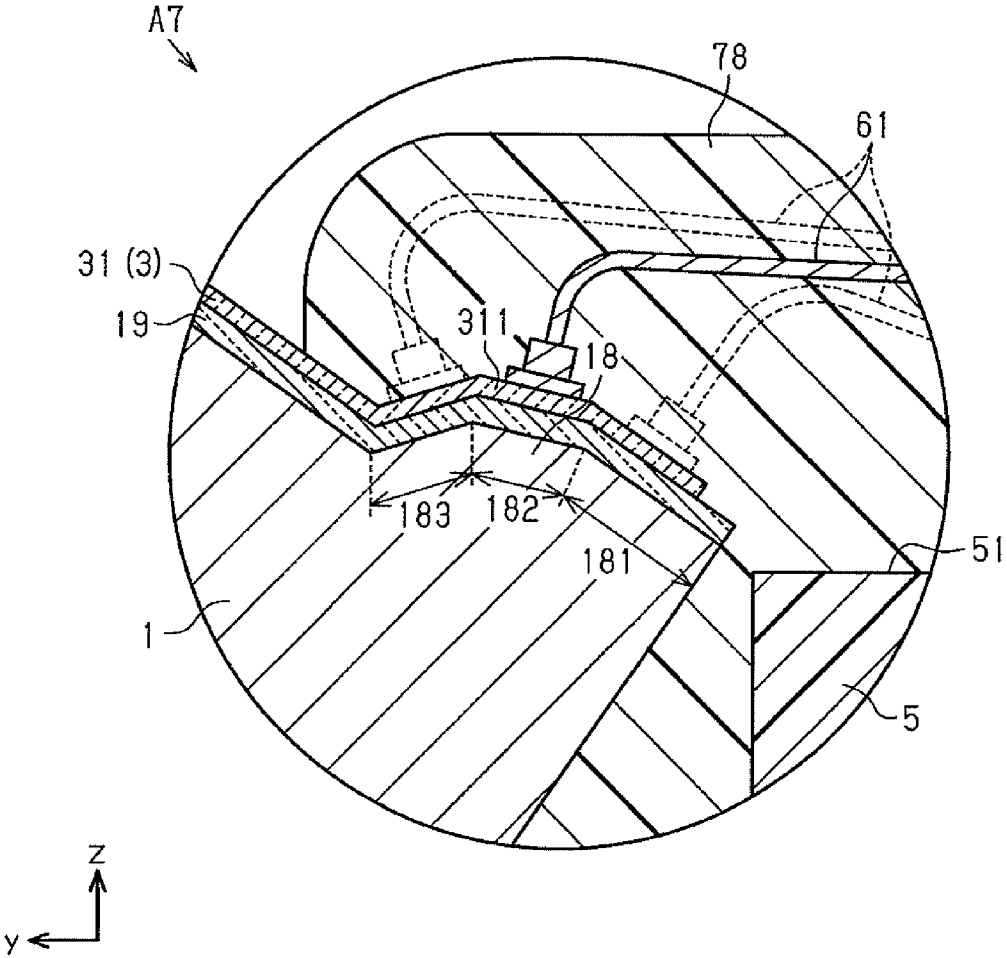
FIG. 28 is an enlarged diagram of FIG. 27.

As shown in FIG. 28, the substrate 1 includes a pad convex portion 18. The pad convex portion 18 is disposed on the substrate 1 on an end portion located at the upstream in the sub scan direction y. The pad convex portion 18 protrudes from the first main surface 11. The pad convex portion 18 includes, for example, a first pad surface 181, a second pad surface 182 and a third pad surface 183.

The first pad surface 181 is a surface located most upstream in the sub scan direction y in the pad convex portion 18. The first pad surface 181 is, for example, parallel to the first main surface 11.

The third pad surface 183 is a surface located most downstream in the sub scan direction y in the pad convex portion 18, and is connected to the first main surface 11. The third pad surface 183 inclines relative to the first main surface 11 and the first pad surface 181.

The second pad surface 182 is a surface located between the first pad surface 181 and the third pad surface 183 in the pad convex portion 18, and is connected to the first pad surface 181 and the third pad surface 183. The second pad surface 182 inclines relative to the first main surface 11, the first pad surface 181 and the third pad surface 183.

The wiring layer 3 of the seventh embodiment similarly includes a plurality of separating electrodes 31, a plurality of common electrodes 32 and a plurality of relay electrodes 33, as the fourth embodiment and the fifth embodiment. Each separating electrode 31 includes a separating pad 311. Each common electrode 32 includes a pad (not shown) having a configuration identical to that of the separating pad 311.

In the seventh embodiment, the separating pads 311 and the pads of the common electrodes 32 are arranged on the first pad surface 181, the second pad surface 182 and the third pad surface 183. The separating pads 311 and the pads of the common electrodes 32 are arranged in an alternating manner in the main scan direction x with respect to the pad convex portion 18. The metal wire 61 in a solid line shown in FIG. 27 is connected to the separating pad 311 formed on the second pad surface 182. The metal wires 61 in dotted lines in FIG. 27 are connected to the pads formed on the first pad surface 181 and the third pad surface 183. The metal wires 61 connected to the pads of the common electrodes 32 may also be connected to the wiring layer on the circuit substrate 5 instead of being connected to the driver integrated circuit 7.

In addition to effects described above, the seventh embodiment further achieves the following effects.

(7-1) By inclining the substrate 1 relative to the circuit substrate 5, the convex portion 13 may be disposed on a position higher than the protective resin 78. Thus, even if the platen roller 91 is not closer to the downstream in the sub scan direction y than the convex portion 13, the possibility of interference generated between the platen roller 91 and the protective resin 78 is similarly lowered.

(7-2) By inclining the substrate 1 relative to the circuit substrate 5, the dimension of the substrate 1 in the sub scan direction y may be reduced.

(7-3) The substrate 1 including the pad convex portion 18 may lower the possibility that the separating pad 311 bonded with the metal wire 61 overly inclines relative to the second main surface 51, if the substrate 1 is disposed as inclining relative to the circuit substrate 5. In this case, the metal wire 61 may be appropriately bonded.

Eighth Embodiment

A thermal print head according to an eighth embodiment is described below. In the eighth embodiment, configuration differences from the first embodiment to the seventh embodiment are primarily explained. In the eighth embodiment, components identical to those of the first embodiment to the seventh embodiment are represented by the same denotations as the first embodiment to the seventh embodiment, and such repeated description is omitted herein.

Figure 29:
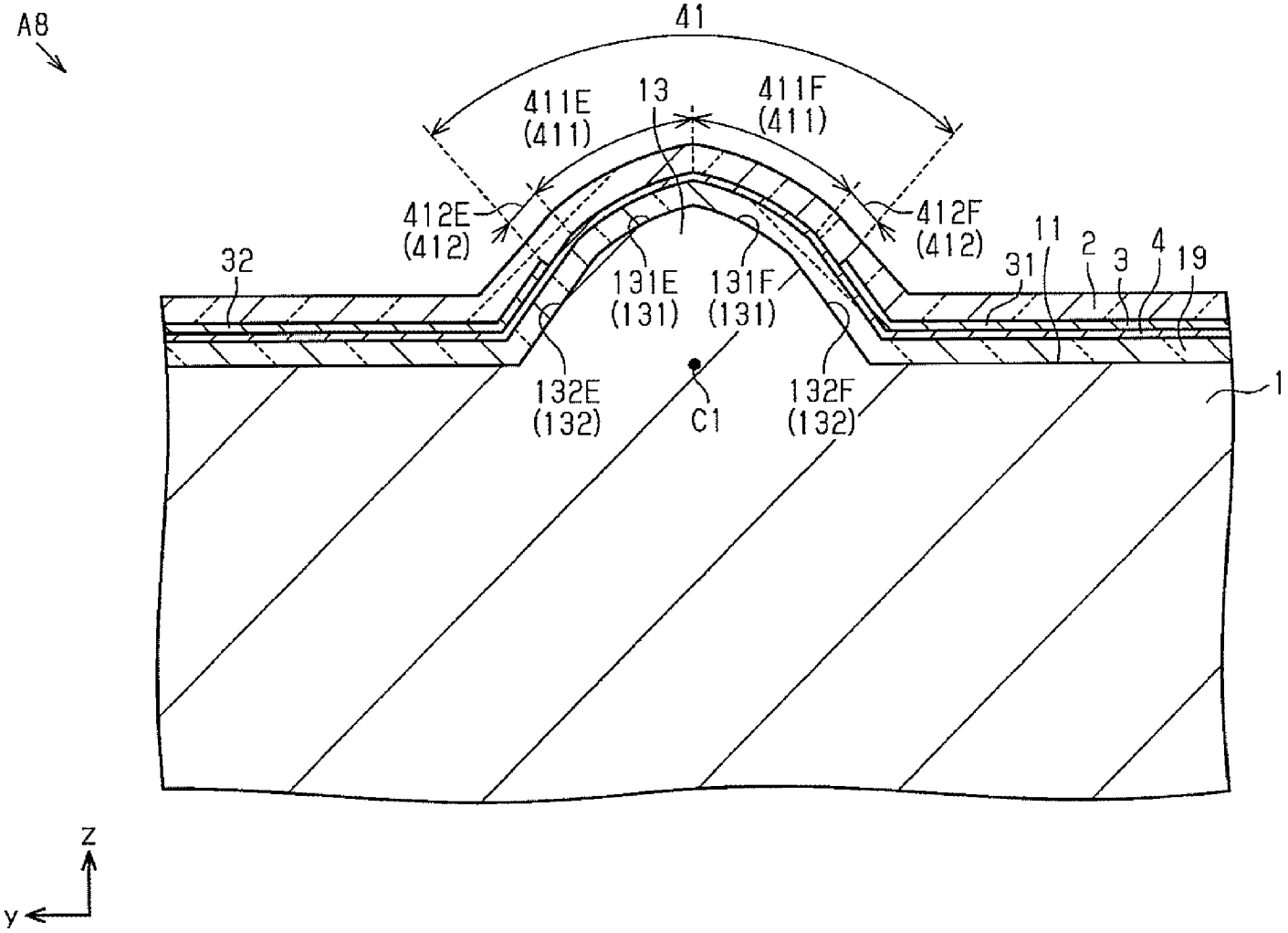
FIG. 29 is a cross-sectional diagram of a thermal print head according to an eighth embodiment.

As shown in FIG. 29, in a thermal print head A8, the convex portion 13 has the curving surface 131 and the inclining surface 132, but does not have the top surface 130. The convex portion 13 has the first curving surface 131E, the second curving surface 131F, the first inclining surface 132E and the second inclining surface 132F.

The first curving surface 131E is connected to the first inclining surface 132E and the second curving surface 131F. The second curving surface 131F is connected to the second inclining surface 132F and the first curving surface 131E. Thus, in the eighth embodiment, the border between the first curving surface 131E and the second curving surface 131F becomes the vertex of the convex portion 13.

In the eighth embodiment, each heating portion 41 includes the heating curving portion 411 and the heating inclining portion 412, but does not include the heating top portion 410. Each heating portion 41 includes the first heating curving portion 411E, the second heating curving portion 411F, the first heating inclining portion 412E and the second heating inclining portion 412F.

The first heating curving portion 411E is connected to the first heating inclining portion 412E and the second heating curving portion 411F. The second heating curving portion 411F is connected to the second heating inclining portion 412F and the first heating curving portion 411E.

In addition to effects described above, the eighth embodiment further achieves the following effects.

(8-1) The convex portion 13 does not have the top surface 130. Thus, compared to the convex portion 13 having the top surface 130, the convex portion 13 may be miniaturized.

Variation Example

The embodiments described above are exemplary forms that may be used for the thermal print head of the present invention, and are not to be construed as limitations to the forms thereof. The thermal print head of the present invention may be implemented in forms that are different from the exemplary forms provided in the embodiments. One of the examples is a form obtained after substituting, modifying or omitting a part of the configurations of the embodiments, or adding a new configuration to the configurations of the embodiments. In the variation example below, parts in common with those in the described embodiments are represented by the same denotations as those in the described embodiments, and the repeated description is omitted herein.

- The surface roughness of the curving surface 131 may be more than the surface roughness of the inclining surface 132, less than the surface roughness of the inclining surface 132, or equal to the surface roughness of the inclining surface 132.
- In the substrate 1, in addition to the insulating layer 19, the resistor layer 4, the wiring layer 3 and the protective layer 2, other layers may also be formed.
- The length of the curving surface 131 in the thickness direction z may be more than the length of the inclining surface 132 in the thickness direction z.
- The length of the curving surface 131 in the main scan direction x may be less than the length of the inclining surface 132 in the main scan direction x.
- The heating portion 41 may also be disposed closer to the upstream in the sub scan direction y on the convex portion 13.
- The heating portion 41 may also be formed on a portion corresponding to the third inclining surface 132G.
- The heating portion 41 may also be formed on a portion corresponding to the fourth inclining surface 132H.
- The convex portion 13 may also be an asymmetric shape in the sub scan direction y with the center of the convex portion 13 as a reference when viewing from the main scan direction x.
- The first embodiment to the eighth embodiment and the variation example may be implemented in combination without contradicting the technical scope of the present invention.

(Notes)

The technical concept encompassed by the embodiments above and variation example and the effects and results thereof are described below.

(Note 1) A method for manufacturing a thermal print head is a method for manufacturing a thermal print head including a substrate, a resistor layer and a wiring layer. The substrate is formed with single crystal semiconductor, and has a main surface and a convex portion protruding from the main surface. The resistor layer includes a plurality of heating portions arranged in a main scan direction. The wiring layer configures a charging path to the plurality of heating portions. The method for manufacturing a thermal print head includes a first step and a second step as a step for forming the convex portion. The first step forms, by performing anisotropic etching using KOH on a substrate material including the single crystal semiconductor, an inclining surface inclining relative to the main surface and extending in a linear manner, and the second step forms, by performing anisotropic etching using TMAH after the first step, a curving surface curving in a manner that protrudes toward the protruding direction of the convex portion.

What is claimed is:

1. A thermal print head, comprising:

a substrate, formed with single crystal semiconductor;

a resistor layer, comprising a plurality of heating portions arranged in a main scan direction; and a wiring layer, configuring a charging path to the plurality of heating portions;

wherein, the substrate comprises:

a main surface, being a surface opposite to the resistor layer; and a convex portion, disposed as protruding from the main surface and extending in the main scan direction, the convex portion comprising:

an inclining surface, inclining relative to the main surface and extending in a linear manner when viewing from the main scan direction; and a curving surface, disposed, in a protruding direction of the convex portion, on a position farther away from the main surface than the inclining surface, and curving in a manner that protrudes toward the protruding direction; and each of the plurality of heating portions comprises:

a heating curving portion, formed on a portion corresponding to the curving surface, wherein each of the plurality of heating portions comprises a heating inclining portion formed on a portion corresponding to the inclining surface and being continuous with the heating curving portion; and wherein a border portion between the inclining surface and the curving surface is curved.

2. The thermal print head according to claim 1, wherein the heating curving portion is formed by a portion of the resistor layer, the portion being formed on the curving surface.

3. The thermal print head according to claim 1, wherein the resistor layer is formed on the inclining surface, the wiring layer is formed in a manner of covering a part of the portion of the resistor layer formed on the inclining surface, and the heating inclining portion is a portion of the resistor layer formed on the inclining surface and configured by a portion not covered by the wiring layer.

4. The thermal print head according to claim 1, wherein the convex portion comprises a top surface located on a position in the protruding direction and having a largest distance from the main surface, and the curving surface is a surface connected to the top surface and the inclining surface in a sub scan direction.

5. The thermal print head according to claim 4, wherein a border portion between the curving surface and the top surface is curved.

6. The thermal print head according to claim 4, wherein the convex portion comprises two of the curving surfaces on positions spaced by the top surface in the sub scan direction.

7. The thermal print head according to claim 6, wherein the top surface is parallel to the main surface, the convex portion comprises two of the inclining surfaces on positions spaced by the top surface in the sub scan direction, and the two inclining surfaces and the two curving surfaces are disposed as being symmetric with respect to the top surface as a reference in the sub scan direction.

8. The thermal print head according to claim 4, wherein the heating portion comprises a heating top portion formed on a portion corresponding to the top surface and being continuous with the heating curving portion.

9. The thermal print head according to claim 1, wherein the substrate, the resistor layer and the wiring layer are sequentially laminated.

10. The thermal print head according to claim 1, wherein surface roughness of the curving surface is less than surface roughness of the inclining surface.

11. The thermal print head according to claim 1, wherein an angle formed by a tangential line of the curving surface and the main surface is equal to or less than an angle formed by the inclining surface and the main surface.

12. The thermal print head according to claim 1, wherein a length of the curving surface in the protruding direction is less than a length of the inclining surface in the protruding direction.

13. The thermal print head according to claim 1, wherein an angle formed by a tangential line of the curving surface and the main surface is equal to or more than 22 degrees and equal to or less than 38 degrees.

14. The thermal print head according to claim 1, wherein a length of the curving surface in the sub scan direction is more than a length of the inclining surface in the sub scan direction.

15. The thermal print head according to claim 1, wherein the substrate comprises Si.

16. The thermal print head according to claim 1, wherein the main surface is a (100) surface.

17. The thermal print head according to claim 1, wherein an angle formed by the inclining surface and the main surface is equal to or more than 50 degrees and equal to or less than 60 degrees.

18. The thermal print head according to claim 1, the main surface being a first main surface, the thermal print head comprising:

a circuit substrate, comprising a second main surface, being located more upstream in the sub scan direction than the substrate; and a driver integrated circuit, disposed on the second main surface, controlling powering to the heating portions.

19. The thermal print head according to claim 18, comprising a heat dissipation member supporting the substrate and the circuit substrate.

20. The thermal print head according to claim 18, wherein the second main surface is parallel to the first main surface.

21. The thermal print head according to claim 18, wherein the second main surface inclines relative to the first main surface.

22. The thermal print head according to claim 18, wherein the substrate comprises a connecting inclining surface on a position more upstream in the sub scan direction than the convex portion, the connecting inclining surface inclines in a manner that thickness thereof increases from downstream to upstream in the sub scan direction, the wiring layer comprises a plurality of pads formed on the connecting inclining surface, and the pads are wire bonding pads.

* * * * *